US008100345B2

(12) United States Patent
Hotta et al.

(10) Patent No.: US 8,100,345 B2
(45) Date of Patent: Jan. 24, 2012

(54) FUEL INJECTION DEVICE

(75) Inventors: Yoshihiro Hotta, Nagoya (JP); Yoshifumi Wakisaka, Nagoya (JP); Kiyomi Kawamura, Nisshin (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 1038 days.

(21) Appl. No.: 11/632,662

(22) PCT Filed: Jul. 21, 2005

(86) PCT No.: PCT/JP2005/013782

§ 371 (c)(1),
(2), (4) Date: Jan. 17, 2007

(87) PCT Pub. No.: WO2006/025165

PCT Pub. Date: Mar. 9, 2006

(65) Prior Publication Data

US 2008/0041977 A1 Feb. 21, 2008

(30) Foreign Application Priority Data

Jul. 21, 2004 (JP) ..... 2004-212664

(51) Int. Cl.

| | |
|---|---|
| ***F02M 47/02*** | (2006.01) |
| *F02M 59/00* | (2006.01) |
| *F02M 61/00* | (2006.01) |
| *F02M 63/00* | (2006.01) |

(52) U.S. Cl. ..... 239/91; 239/88; 239/89; 239/533.2; 239/533.7

(58) Field of Classification Search ..... 239/88–92
See application file for complete search history.

(56) References Cited

U.S. PATENT DOCUMENTS

| | | | |
|---|---|---|---|
| 5,622,152 | A | 4/1997 | Ishida |
| 5,697,342 | A | 12/1997 | Anderson et al. |
| 5,711,277 | A | 1/1998 | Fuseya |
| 6,113,000 | A | 9/2000 | Tian |

(Continued)

FOREIGN PATENT DOCUMENTS

| | | |
|---|---|---|
| JP | B2 47-38648 | 9/1972 |

(Continued)

OTHER PUBLICATIONS

Office Action from Japanese Patent Application No. 2007-153614 dated Sep. 8, 2009 with translation.

(Continued)

*Primary Examiner* — Len Tran
*Assistant Examiner* — James Hogan
(74) *Attorney, Agent, or Firm* — Oliff & Berridge, PLC

(57) ABSTRACT

A needle is forced to open an injection hole by reducing a pressure of fuel in an injection control chamber to thereby inject fuel stored in a fuel storage, while the needle is forced to close the injection hole by increasing the pressure of fuel in the injection control chamber to thereby terminate injection of fuel from the injection hole. In a valve-closing stroke of the needle to close the injection hole, fuel pressure is supplied from a common accumulator to the fuel storage and the injection control chamber in such a manner that the pressure to supply fuel to the fuel storage is lower than that to supply fuel to the injection control chamber. In this way, a force acting on the needle toward the injection hole side can be increased in the valve-closing stroke, to thereby accelerate a valve-closing speed of the needle.

5 Claims, 12 Drawing Sheets

U.S. PATENT DOCUMENTS

| | | | | |
|---|---|---|---|---|
| 6,427,664 | B1 | 8/2002 | Boecking | |
| 6,443,129 | B1 | 9/2002 | Boecking | |
| 6,453,875 | B1 | 9/2002 | Mahr et al. | |
| 6,629,647 | B2 * | 10/2003 | Boecking | 239/88 |
| 6,675,773 | B1 | 1/2004 | Mahr et al. | |
| 6,688,277 | B1 * | 2/2004 | Mahr et al. | 123/299 |
| 6,752,325 | B2 | 6/2004 | Kropp et al. | |
| 6,793,162 | B2 * | 9/2004 | Dallmeyer et al. | 239/585.1 |
| 6,845,757 | B2 * | 1/2005 | Strahberger et al. | 123/467 |
| 6,880,527 | B2 | 4/2005 | Magel | |
| 6,892,703 | B2 * | 5/2005 | Magel | 123/446 |
| 7,066,400 | B2 * | 6/2006 | Brenk et al. | 239/124 |
| 7,188,782 | B2 * | 3/2007 | Magel | 239/96 |
| 7,210,639 | B2 * | 5/2007 | Magel | 239/88 |
| 7,320,310 | B2 * | 1/2008 | Eisenmenger et al. | 123/446 |
| 7,461,795 | B2 * | 12/2008 | Magel | 239/88 |
| 2001/0020648 | A1 * | 9/2001 | Boecking | 239/88 |
| 2002/0088435 | A1 | 7/2002 | Kropp et al. | |
| 2003/0127539 | A1 * | 7/2003 | Braun et al. | 239/533.2 |
| 2004/0025843 | A1 | 2/2004 | Magel | |
| 2004/0025845 | A1 * | 2/2004 | Magel | 123/447 |
| 2004/0194756 | A1 | 10/2004 | Hotta et al. | |
| 2006/0005815 | A1 | 1/2006 | Magel | |
| 2006/0043209 | A1 | 3/2006 | Magel | |

FOREIGN PATENT DOCUMENTS

| | | | |
|---|---|---|---|
| JP | A 8-21332 | | 1/1996 |
| JP | B2 2885076 | | 2/1999 |
| JP | A 2002-202021 | | 7/2002 |
| JP | A 2003-511626 | | 3/2003 |
| JP | A 2003-512574 | | 4/2003 |
| JP | A-2004-044494 | | 2/2004 |
| JP | A 2004-519614 | | 7/2004 |
| JP | A 2005-83237 | | 3/2005 |
| WO | WO 97/08452 | | 3/1997 |
| WO | WO 00/55496 | | 9/2000 |
| WO | WO 01/14727 | A1 | 3/2001 |
| WO | WO 01/27466 | A1 | 4/2001 |
| WO | WO 01/29396 | A2 | 4/2001 |
| WO | WO 02/093001 | A1 | 11/2002 |
| WO | WO 2004/036027 | A1 | 4/2004 |
| WO | WO 2004/036030 | A1 | 4/2004 |
| WO | WO 2005015002 | A1 * | 2/2005 |

OTHER PUBLICATIONS

Extended European Search Report dated Apr. 8, 2011, completed Apr. 1, 2011 in European Application No. EP 05 76 7202.

Kenji Funai et al., "Injection Rate Shaping Technology with Common Rail Fuel System (ECD-U2)," SAE Technical Papers Series 960107, pp. 1-7, Feb. 26-29, 1996.

* cited by examiner

FUEL INJECTION DEVICE

TECHNICAL FIELD

The present invention relates to a fuel injection device and, more particularly, to a fuel injection device in which a needle is caused to open an injection hole by reducing a pressure of fuel in an injection control chamber, to thereby inject fuel stored in a fuel storage from the injection hole, while the needle is caused to close the injection hole by increasing the pressure of fuel in the injection control chamber, to thereby terminate injection of fuel from the injection hole.

BACKGROUND ART

A technology relating to this type of fuel injection device is disclosed in Japanese Patent No. 2885076 and International Publication No. 00/55496. A fuel injection device in the related technology will be described with reference to FIG. 12.

At a time when fuel is injected, an injection control chamber 3 is connected via an orifice 35 to a drain 22 by means of an injection control valve 7, for reducing the pressure inside the injection control chamber 3 to a level close to atmospheric pressure. Then, because a force acting on a needle 51 toward the injection control chamber 3 side exceeds a force toward an injection hole 23 side, the needle 51 is moved toward the injection control chamber 3 side, thereby opening the injection hole 23. As a result, the fuel stored in a fuel storage 52 is injected from the injection hole 23 into a combustion chamber of an internal combustion engine (not illustrated).

In addition, a booster control chamber 102 is connected to the drain 22 by means of a booster control valve 8, thereby reducing the pressure inside the booster control chamber 102 to a level close to atmospheric pressure. When the pressure inside the booster control chamber 102 reaches the level, a booster piston 10 is actuated to thereby increase the pressure of fuel in a booster chamber 103, which in turn increases the pressure of fuel stored in the fuel storage 52. In this manner, the fuel stored in the fuel storage 52 can be pressurized and injected at an increased pressure. It should be noted that because the booster chamber 103 communicates with the injection control chamber 3 via an orifice 60, the pressure inside the booster chamber 103 increased by the booster piston 10 is supplied to the booster control chamber 3 via the orifice 60 in addition to being supplied to the fuel storage 52. Because of this, even when the booster control chamber 102 is connected to the drain 22 in a state where the injection control chamber 3 is not connected to the drain 22, there is prevented movement of the needle 51 toward the injection control chamber 3 side, which would result in the opening of the injection hole 23.

Meanwhile, when the injection of fuel is terminated, communication between the injection control chamber 3 and the drain 22 is interrupted by means of the injection control valve 7. Then, because fuel pressure is supplied from a common accumulator 2 via a check valve 59 and the orifice 60 to the injection control chamber 3, the force exerted on the needle 51 toward the injection hole 23 side becomes greater than the force toward the injection control chamber 3 side, which moves the needle 51 toward the injection hole 23 side to thereby close the injection hole 23. Subsequently, fuel is supplied from the common accumulator 2 via the check valve 59 to the fuel storage 52 and the booster chamber 103.

In addition, when the pressure inside the booster control chamber 102 is increased to a common rail pressure by connecting the booster control chamber 102 to the common accumulator (common rail) 2 by means of the booster control valve 8, the pressures above and below the booster piston 10 are balanced as appropriate, so that the booster piston 10 actuated by the force of a spring 98 is returned to its initial position.

Other related techniques are disclosed in Japanese Patent Publication No. Sho 47-38648, International Publication No. 01/14727, U.S. Pat. No. 6,427,664, and SAE TECHNICAL PAPER SERIES 960107, 1996/2 entitled "Injection Rate Shaping Technology with Common Rail Fuel System (ECD-U2)" by Kenji Funai et al.

In the fuel injection device shown in FIG. 12, when the injection of fuel is terminated, the pressure of fuel supplied from the common accumulator 2 via the check valve 59 and the orifice 60 to the injection control chamber 3 pushes the needle 51 toward the injection hole 23 side. However, the pressure of fuel supplied from the common accumulator 2 via the check valve 59 to the fuel storage 52 also pushes the needle 51 toward the injection control chamber 3 side, which hampers movement of the needle 51 for closing the injection hole 23. Accordingly, there is a problem in that when the needle 51 closes the injection hole 23, performance of terminating the injection of fuel is degraded, and a state of atomization of injected fuel is in turn deteriorated.

Further, in the fuel injection device shown in FIG. 12, the pressure inside the booster chamber 103 increased by the booster piston 10 is supplied via the orifice 60 to the injection control chamber 3, in addition to being supplied to the fuel storage 52. Because the injection control chamber 3 communicates via the orifice 35 with the drain 22 when fuel is injected, a portion of the fuel increased in pressure by the booster piston 10 is discharged through the injection control chamber 3 to the drain 22, which results in a problem that difficulty is encountered in effectively pressurizing and injecting the fuel stored in the fuel storage 52 by means of the booster piston 10.

Still further, during low-load operation of an internal combustion engine, desirably, a fuel injection rate is suppressed in an initial phase of injection, in view of reducing combustion noise. On the other hand, during high-load operation of the internal combustion engine, in view of securing high power, it is desired that a high injection rate be rapidly attained rather than suppressing the fuel injection rate in the initial phase of injection. As such, it is desired that characteristics of fuel injection rate be able to be changed appropriately in accordance with an operation state of an internal combustion engine.

It is an advantage of the present invention to provide a fuel injection device which exhibits improved performance in terminating fuel injection when a needle closes an injection hole. It is another advantage of the present invention to provide a fuel injection device capable of efficiently performing operation of injecting fuel pressurized by a booster piston. Further, it is still another advantage of the present invention to provide a fuel injection device capable of appropriately changing characteristics of fuel injection rate in accordance with an operation state of an internal combustion engine.

DISCLOSURE OF THE INVENTION

In order to attain at least one of the aforesaid advantages, a fuel injection device according to the present invention adopts a structure as described below.

According to an aspect of the present invention, a fuel injection device comprises a fuel-injecting unit having a fuel storage for storing fuel supplied from a fuel supply source, a needle for opening and closing an injection hole from which the fuel stored in the fuel storage is injected, and an injection control chamber in which a fuel pressure for pushing the needle toward the injection hole side is supplied from the fuel supply source, where the needle is forced to open the injection hole by reducing a pressure of fuel in the fuel control chamber, to thereby inject the fuel stored in the fuel storage from the injection hole, while the needle is forced to close the injection hole by increasing the pressure of fuel in the injection control chamber, to thereby terminate injection of fuel from the injection hole. In the fuel injection device, the fuel pressure is supplied from the fuel supply source to the fuel storage and the injection control chamber during a valve-closing stroke of the needle to thereby close the injection hole in such a manner that a pressure of supplying fuel to the fuel storage is lower than a pressure of supplying fuel to the injection control chamber.

In the present invention, because the fuel pressure is supplied from the fuel supply source to the fuel storage and the injection control chamber in such a manner that the pressure of supplying fuel to the fuel storage is lower than that of supplying fuel to the injection control chamber during the valve-closing stroke of the needle to close the injection hole, a force exerted on the needle toward the injection hole side can be increased. As a result, during the valve-closing stroke of the needle to close the injection hole, a travel speed of the needle moving toward the injection hole side can be increased, to thereby enable an improvement in termination of fuel injection when the needle closes the injection hole in the present invention.

In the fuel injection device according to the present invention, fuel pressure may be supplied from the fuel supply source via a first throttle section to the fuel storage and also supplied from the fuel supply source via a second throttle section to the injection control chamber during the valve-closing stroke, and a channel area in the first throttle section may be set smaller than that in the second throttle section. With this configuration, in the valve-closing stroke of the needle to close the injection hole, it becomes possible to supply the fuel pressure from the fuel supply source to the fuel storage and the injection control chamber in such a manner that the pressure of supplying fuel to the fuel storage is lower than that of supplying fuel to the injection control chamber.

In the fuel injection device according to the present invention, the fuel pressure may be supplied from the injection control chamber via a throttle section to the fuel storage during the valve-closing stroke. With this configuration, in the valve-closing stroke of the needle to close the injection hole, it becomes possible to supply the fuel pressure from the fuel supply source to the fuel storage and the injection control chamber in such a manner that the pressure of supplying fuel to the fuel storage is lower than that of supplying fuel to the injection control chamber.

The fuel injection device according to the present invention may further comprise a pressure booster unit for increasing the pressure of the fuel stored in the fuel storage by actuation of the booster piston.

In the fuel injection device according to the aspect of the present invention having the pressure booster unit, the pressure booster unit comprises a booster chamber communicating with the fuel storage and pressurized by the actuation of a booster piston; a pressurization chamber in which a pressure for pushing the booster piston toward the booster chamber side is supplied from the fuel supply source; and a control chamber in which a pressure for pushing the booster piston toward the pressurization chamber side is supplied and the supplied pressure is regulated to control the actuation of the booster piston. In the booster piston, an area pushed toward the booster chamber side by the pressure inside the pressurization chamber may be made smaller than the sum of an area pushed toward the pressurization chamber side by the pressure inside the booster chamber and an area pushed toward the pressurization chamber side by the pressure inside the control chamber. With the areas set as described above, the booster piston can be returned to its initial position with reliability even when the pressure of supplying fuel to the fuel storage which communicates with the booster chamber becomes lower than the pressure of supplying fuel to the injection control chamber in the valve-closing stroke of the needle to close the injection hole.

In the fuel injection device according to the aspect of the present invention having the pressure booster unit, inflow and outflow of fuel are performed in the injection control chamber such that a flow amount of fuel flowing out from the injection control chamber during a valve-opening stroke of the needle to open the injection hole is smaller than a flow amount of fuel flowing into the injection control chamber during the valve-closing stroke, and the fuel pressure in the fuel storage at a time of actuation of the booster piston may be regulated by adjusting the fuel pressure in the fuel supply source, to thereby enable adjustment of a fuel injection rate during the valve-opening stroke. In this way, it becomes possible to appropriately change characteristics of fuel injection rate in accordance with the operation state of an internal combustion engine.

In the fuel injection device according to the present invention, during low-load operation of an internal combustion engine into which fuel is injected, the fuel pressure in the fuel supply source may be adjusted such that the fuel injection rate in the valve-opening stroke is suppressed to a predetermined injection rate or lower. In this way, during the low-load operation of the internal combustion engine, there can be realized characteristics of fuel injection rate such that the injection rate is suppressed in the initial phase of injection.

In the fuel injection device according to the present invention, during high-load operation of the internal combustion engine into which fuel is injected, the fuel pressure in the fuel supply source may be adjusted so as to compensate for a reduction of the fuel injection rate during the valve-opening stroke caused by a condition that the flow amount of fuel flowing out from the injection control chamber is smaller than the flow amount of fuel flowing into the injection control chamber. In this way, it becomes possible to realize characteristics of fuel injection rate such that a high injection rate is attained at an early stage.

The fuel injection device according to the present invention may further comprise a control valve for selectively connecting the injection control chamber to the fuel supply source or the drain, and a one-way orifice disposed between the control valve and the injection control chamber, in which an area of a channel through which fuel flows from the injection control chamber to the control valve is smaller than that of a channel through which fuel flows from the control valve to the injection control chamber. With this configuration, the flow amount of fuel flowing from the injection control chamber in the valve-opening stroke of the needle to open the injection hole can be maintained at a level lower than the flow amount of fuel flowing into the injection control chamber in the valve-closing stroke of the needle to close the injection hole.

In the fuel injection device according to the aspect of the present invention having the pressure booster unit, the pressure booster unit may comprise a booster chamber communicating with the fuel storage and pressurized by actuation of the booster piston, and a booster control chamber in which the pressure of supplying fuel is regulated to control the actuation of the booster piston. In the pressure booster unit, fuel supply from the booster chamber to the injection control chamber is blocked, and the fuel pressure in the injection control chamber and the fuel pressure in the booster control chamber are controlled by means of a common control valve. With this configuration, operation of injecting the fuel pressurized by the booster piston can be performed with high efficiency.

In the fuel injection device according to the present invention, communication between the booster chamber and the injection control chamber may be interrupted. In this way, there can be prevented supply of the fuel pressurized by the booster piston to the injection control chamber.

In the fuel injection device according to the present invention, the booster chamber may be connected via a check valve to the injection control chamber, the check valve allowing flow of fuel from the injection control chamber to the booster chamber while blocking flow of fuel from the booster chamber to the injection control chamber. In this way, there can be prevented supply of the fuel pressurized by the booster piston to the injection control chamber.

In the fuel injection device according to the present invention, the booster chamber may be connected via a check valve to the booster control chamber, and the check valve allows flow of fuel from the booster control chamber to the booster chamber while blocking flow of fuel from the booster chamber to the booster control chamber. In this way, there can be prevented supply of the fuel pressurized by the booster piston to the booster control chamber.

According to a further aspect of the present invention, the fuel injection device comprises the fuel injection unit having the fuel storage for storing fuel supplied from the fuel supply source, the needle for opening and closing the injection hole from which the fuel stored in the fuel storage is injected, and the injection control chamber in which fuel pressure for pushing the needle toward the injection hole side is supplied from the fuel supply source; and the pressure booster unit for increasing the pressure of the fuel stored in the fuel storage by actuation of the booster piston. In the fuel injection device, the needle is forced to open the injection hole by reducing the pressure of fuel in the injection control chamber, to thereby inject the fuel stored in the fuel storage from the injection hole, while the needle is forced to close the injection hole by increasing the pressure of fuel in the injection control chamber, to thereby terminate injection of fuel from the injection hole. Further, in the fuel injection device, inflow and outflow of fuel are performed in such a manner that the flow amount of fuel flowing out from the injection control chamber during the valve-opening stroke of the needle to open the injection hole is smaller than the flow amount of fuel flowing into the fuel control chamber during the valve-closing stroke of the needle to close the injection hole, and the fuel pressure in the fuel storage at a time of actuation of the booster piston is regulated by adjusting the fuel pressure in the fuel supply source, to thereby enable adjustment of the fuel injection rate during the valve-opening stroke.

According to the present invention, characteristics of the fuel injection rate can be changed as appropriate in accordance with the operation state of an internal combustion engine by adjusting the fuel injection rate in the valve-opening stroke of the needle to open the injection hole.

Further, according to still another aspect of the present invention, the fuel injection device comprises the fuel injection unit having the fuel storage for storing fuel supplied from the fuel supply source, the needle for opening and closing the injection hole from which the fuel stored in the fuel storage is injected, and the injection control chamber in which fuel pressure for pushing the needle-toward the injection hole side is supplied from the fuel supply source; and the pressure booster unit for increasing the pressure of the fuel stored in the fuel storage by actuation of the booster piston. In the fuel injection device, the needle is forced to open the injection hole by reducing the pressure of fuel in the injection control chamber, to thereby inject the fuel stored in the fuel storage from the injection hole, while the needle is forced to close the injection hole by increasing the pressure of fuel in the injection control chamber, to thereby terminate injection of fuel from the injection hole. Further, in the fuel injection device, the pressure booster unit comprises the booster chamber communicating with the fuel storage and pressurized by actuation of the booster piston, and the booster control chamber in which the pressure of supplying fuel is regulated to control the actuation of the booster piston, in which fuel supply from the booster chamber to the injection control chamber is blocked, and the fuel pressure in the injection control chamber and the fuel pressure in the booster control chamber are controlled by means of the common control valve.

According to the present invention, because supply of the fuel pressurized by the booster piston to the injection control chamber is prevented, operation of injecting the fuel pressurized by the booster piston can be performed with high efficiency.

BRIEF DESCRIPTION OF THE DRAWINGS

FIG. 3 is a schematic diagram showing a configuration of a fuel injection device used for analyzing a fuel injection rate and the like;

FIG. 4 is a schematic diagram showing a configuration of the fuel injection device used for analyzing the fuel injection rate and the like;

FIG. 5 is a diagram showing the result of analyzing the fuel injection rate and the like;

FIG. 7 is a diagram showing the result of analyzing the fuel injection rate and the like;

FIG. 8 is a diagram showing the result of analyzing the fuel injection rate and the like;

BEST MODE FOR CARRYING OUT THE INVENTION

Preferred embodiments of the present invention will be described below with reference to the drawings.

(1) Embodiment 1

Figure 1:
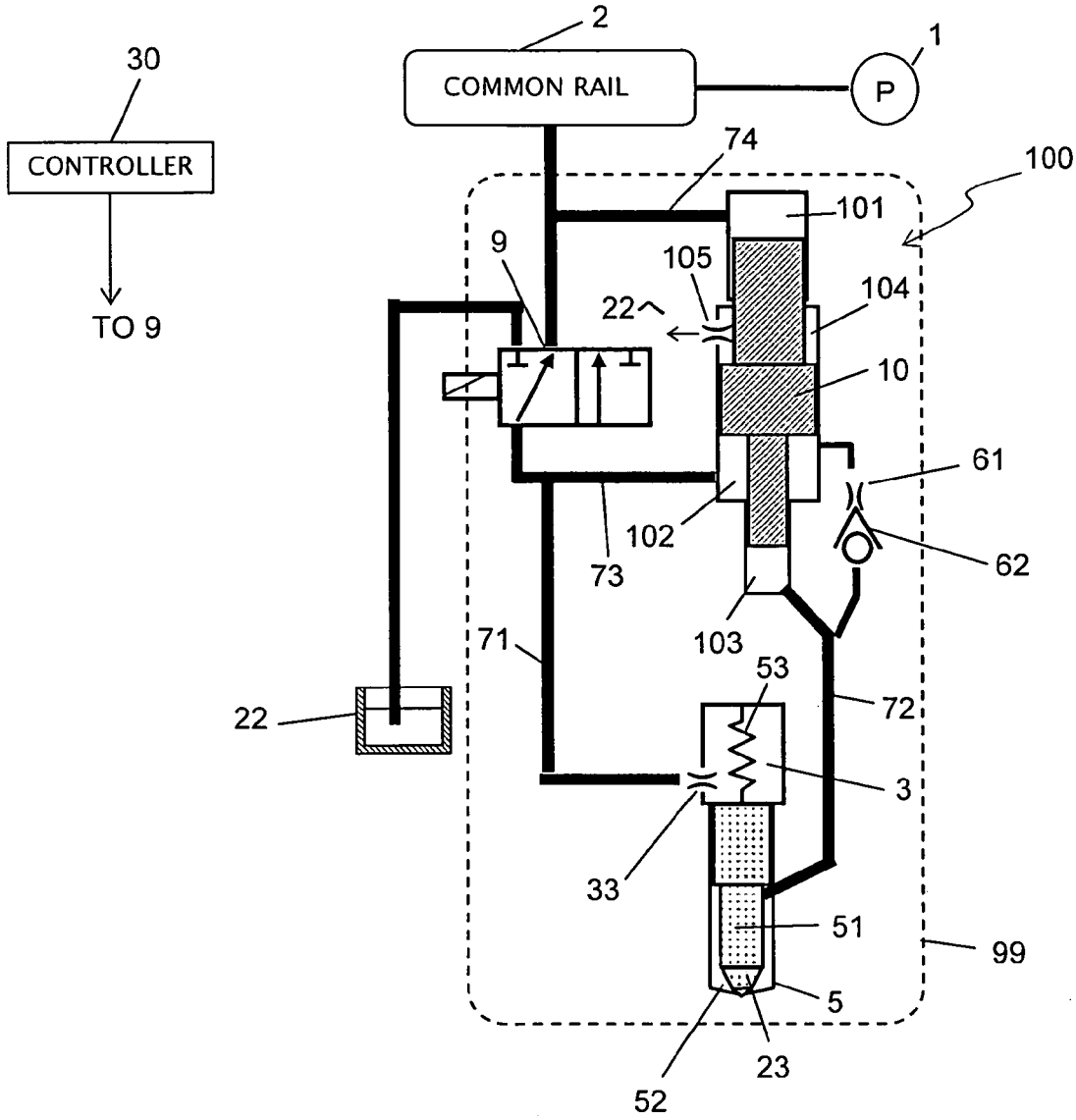
FIG. 1 is a schematic diagram showing a configuration of a fuel injection device according to a first embodiment of the present invention.
Figure 2:
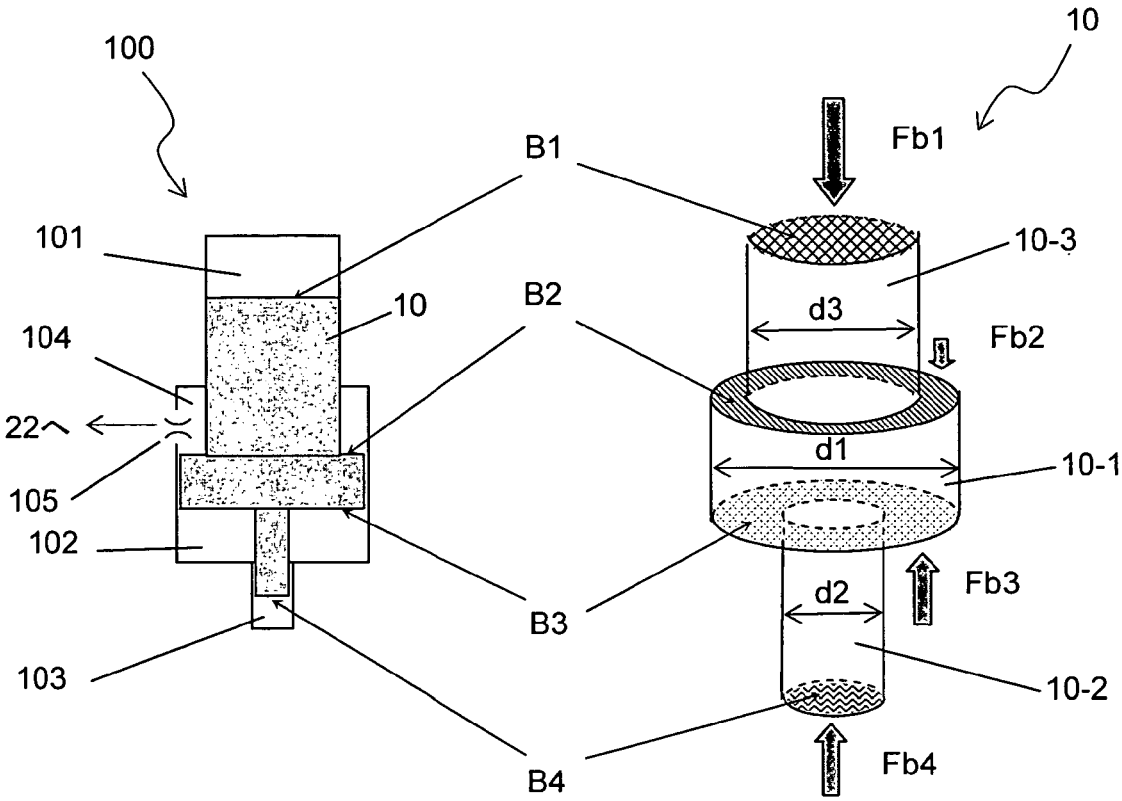
FIG. 2 is a schematic diagram showing a configuration of a pressure booster unit in the first embodiment of the present invention.

FIGS. 1 and 2 schematically show a configuration of a fuel injection device according to Embodiment 1 of the present invention, in which an overall configuration is shown in FIG. 1, and a configuration of a pressure booster unit is shown in FIG. 2. The fuel injection device in the present embodiment, which may be applied, for example, to internal combustion engines of compression ignition type, comprises a fuel pressurization pump 1, a common accumulator (common rail) 2, and an injector 99. The injector 99 provided for each cylinder includes a fuel injection nozzle 5, a control valve 9, and a pressure booster unit 100. The fuel injection using the fuel injection device according to the present embodiment is controlled by a controller 30.

The fuel pressurization pump 1 pumps fuel stored in a tank (not illustrated) and supplies the pumped fuel to the common accumulator 2. The common accumulator 2 stores the fuel supplied from the fuel pressurization pump 1 at a predetermined pressure. A pressure sensor (not illustrated) is installed in the common accumulator 2, and fuel pressure inside the common accumulator 2 (a common rail pressure) is detected by means of the pressure sensor. Detection values from the pressure sensor are input into the controller 30, whereby a regulator (not illustrated) installed in the common accumulator 2 is controlled by the controller 30 such that the fuel pressure inside the common accumulator 2 is maintained at a set pressure. Here, the set pressure is a value on the order of 40~140 MPa, for example, and the value defined as the set pressure in the controller 30 becomes greater with increasing engine speed and with an increase in required torque (drive load).

The fuel injection nozzle 5 has an injection control chamber 3 and a fuel storage 52 formed therein. Further, an injection hole 23 is formed at the tip of the fuel injection nozzle 5 in which a needle 51 for establishing and breaking communication between the fuel storage 52 and the injection hole 23 is slidably mounted. The fuel injection nozzle 5 is enabled, by actuation of the needle 51, to inject fuel stored in the fuel storage 52 from the injection hole 23 into an unillustrated combustion chamber of an internal combustion engine.

The injection control chamber 3 is connected to the common accumulator 2 or the drain 22 via an injection control chamber orifice (a throttle section) 33, a conduit 71, and the control valve 9. The fuel pressure inside the injection control chamber 3 pushes the needle 51 toward the injection hole 23 side. The injection control chamber orifice 33 is disposed at an inlet and outlet port of the injection control chamber 3. The fuel storage 52 is connected via a conduit 72 to the pressure booster unit 100. The fuel pressure inside the fuel storage 52 pushes the needle 51 toward the injection control chamber 3 side. Further, a force pushing the needle 51 toward the injection hole 23 side is exerted by a valve-closing needle spring 53. An area BN1 of a surface on which the needle 51 is pushed toward the injection hole 23 side by the fuel pressure in the injection control chamber 3 is made equal to an area BN2 of a surface on which the needle 51 is pushed toward the injection control chamber 3 side by the fuel pressure in the fuel storage 52.

The pressure booster unit 100 includes a booster piston 10, and is capable of increasing the pressure of fuel stored in the fuel storage 52 by actuation of the booster piston 10. The pressure booster unit 100 has a pressurization chamber 101, a booster chamber 103, and a booster control chamber 102 formed therein.

The pressurization chamber 101 is connected via a conduit 74 to the common accumulator 2, and fuel pressure is supplied from the common accumulator 2 to the pressurization chamber 101. The fuel pressure inside the pressurization chamber 101 pushes the booster piston 10 toward the booster chamber 103 side. The booster control chamber 102 is connected, via a conduit 73 and the control valve 9, to the common accumulator 2 or the drain 22. Further, the booster control chamber 102 is also connected, via a fuel supply orifice (a throttle section) 61 and a fuel supply check valve (a non-return valve) 62, to the booster chamber 103 and the fuel storage 52. The fuel supply check valve 62 used here allows flow of fuel from the booster control chamber 102 to the booster chamber 103 and to the fuel storage 52, while blocking flow of fuel from the booster chamber 103 and from the fuel storage 52 to the booster control chamber 102. The fuel supply orifice 61 may be formed integrally in the fuel supply check valve 62. The fuel pressure in the booster control chamber 102 pushes the booster piston 10 toward the pressurization chamber 101 side. Here, the booster chamber 103 and the fuel storage 52 are connected to each other via the conduit 72.

As shown in FIG. 2, the booster piston 10 is composed of a major diameter portion 10-1 that receives, at one end, the fuel pressure inside the booster control chamber 102 along a direction toward the pressurization chamber 101 side; a minor diameter portion 10-2 that receives, at one end, the fuel pressure inside the booster chamber 103 along the direction toward the pressurization chamber 101 side and has the other end joined to the one end of the major diameter portion 10-1; and an intermediate diameter portion 10-3 that has one end joined to the other end of the major diameter portion 10-1 and receives the fuel pressure inside the pressurization chamber 101 along a direction toward the booster chamber 103 side. Here, the outside diameter d1 of the major diameter portion 10-1, the outside diameter d2 of the minor diameter portion 10-2, and the outside diameter d3 of the intermediate diameter portion 10-3 satisfy the relationship of $d1>d3>d2$. In accordance with the relationship, an area B1 of a surface over which the booster piston 10 (the other end of the intermediate diameter portion 10-3) is pushed toward the booster chamber 103 side by the fuel pressure inside the pressurization chamber 101 is set so as to be smaller than the sum of an area B3 of a surface over which the booster piston 10 (the one end of the major diameter portion 10-1) is pushed toward the pressurization chamber 101 side by the fuel pressure inside the booster control chamber 102 and an area B4 of a surface over which the booster piston 10 (the one end of the minor diameter portion 10-2) is pushed toward the pressurization chamber 101 side by the fuel pressure inside the booster chamber 103. It should be noted that because d3 is larger than d2, B1 is larger than B4.

The pressure booster unit 100 according to the present embodiment further includes a back pressure chamber 104 formed therein. Because the back pressure chamber 104 communicates via an orifice (a throttle section) 105 with the external drain 22, atmospheric pressure is introduced into the back pressure chamber 104. The booster piston 10 receives the fuel pressure (atmospheric pressure) inside the back pressure chamber 104 along the direction toward the booster chamber 103 side at the other end of the major diameter portion 10-1. Here, taking an area of a surface over which the booster piston 10 (the other end of the major diameter portion 10-1) receives the fuel pressure inside the back pressure chamber 104 along the direction toward the booster chamber 103 side as B2, the relationship $B1+B2=B3+B4$ is established.

The control valve 9 can be switched between a first state (a state depicted in the left side in FIG. 1) in which both the booster control chamber 102 and the injection control chamber 3 are connected to the common accumulator 2 and a second state (a state depicted in the right side in FIG. 1) in which both the booster control chamber 102 and the injection control chamber 3 are connected to the drain 22. When the control valve 9 is switched to the first state, the fuel pressure inside the common accumulator 2 (common rail pressure) is supplied to the booster control chamber 102 and the injection control chamber 3. Further, the fuel pressure in the common accumulator 2 is also supplied via the fuel supply orifice 61 and the fuel supply check valve 62 to the booster chamber 103 and the fuel storage 52. On the other hand, when the control valve 9 is switched to the second state, fuel in the booster control chamber 102 and fuel in the injection control chamber 3 are discharged into the drain 22, which causes both the pressure inside the booster control chamber 102 and the pressure inside the injection control chamber 3 to drop until the pressures approach atmospheric pressure. As described above, in this embodiment, both the fuel pressure inside the booster control chamber 102 and that inside the injection control chamber 3 are controlled by the common control valve 9. Meanwhile, inflows and outflows of fuel in the injection control chamber 3 are delivered through the injection control chamber orifice 33.

The controller 30 controls the pressure inside the common accumulator 2 such that fuel pressure is established at the set pressure in the common accumulator 2. In addition, the controller 30 also controls the switching of the control valve 9 to control the timing of fuel injection.

In the fuel injection device according to the present embodiment configured as described above, a channel area A1 in the fuel supply orifice 61 and a channel area A2 in the injection control chamber orifice 33 are set in such a manner that the channel area A1 is smaller than the channel area A2. Further, because the booster chamber 103 is not connected via any conduit to the injection control chamber 3, there is no communication between the booster chamber 103 and the injection control chamber 3.

Next will be described operation of the fuel injection device according to the present embodiment.

In a time period during which fuel is not injected, the control valve 9 is maintained in the first state. While the control valve 9 is in the first state, fuel in the pressurization chamber 101, fuel in the booster chamber 103, and fuel in the booster control chamber 102 are maintained at a pressure equal to the fuel pressure inside the common accumulator 2 (the common rail pressure). In this state, a force Fb1 exerted on the other end of the intermediate diameter portion 10-3 toward the booster chamber 103 side by the pressure inside the pressurization chamber 101, a force Fb2 exerted on the other end of the major diameter portion 10-1 toward the booster chamber 103 side by the pressure inside the back pressure chamber 104, a force Fb3 exerted on the one end of the major diameter portion 10-1 toward the pressurization chamber 101 side by the pressure inside the booster control chamber 102, and a force Fb4 exerted on the one end of the minor diameter portion 10-2 toward the pressurization chamber 101 side by the pressure inside the booster chamber 103 have a relationship of Fb1+Fb2<Fb3+Fb4. Accordingly, the booster piston 10 is fixed to its initial position by means of a stopper (not illustrated) while receiving a force toward the pressurization chamber 101 side. As a result, boosting of fuel pressure by means of the pressure booster unit 100 is not performed while the control vale 9 is in the first state.

In addition, while the control valve 9 is in the first state, the fuel pressures of the injection control chamber 3 and the fuel storage 52 are equal to the fuel pressure inside the common accumulator chamber 2 (common rail pressure). Then, because the needle 51 is pressed toward the injection hole 23 side by the valve-closing needle spring 53, the injection hole 23 is closed. Accordingly, the needle 51 is not actuated while the control valve 9 is in the first state, and consequently fuel injection is not performed.

On the other hand, in a time period during which fuel is injected, the control valve 9 is switched from the first state to the second state. When the control valve 9 is switched to the second state, the booster control chamber 102 is connected to the drain 22, which reduces the pressure inside the booster control chamber 102 until it approaches atmospheric pressure. Then, a force (Fb1+Fb2) exerted on the booster piston 51 toward the booster chamber 103 side by the fuel pressure exceeds a force (Fb3+Fb4) toward the pressurization chamber 101 side. As a result, the booster piston 10 is actuated so that fuel pressure in the booster chamber 103 is increased accordingly, which, in turn, increases the pressure of fuel stored in the fuel storage 52. Here, an increase ratio is B1/B4.

Further, upon the switching of the control valve 9 to the second state, the injection control chamber 3 is connected via the injection control chamber orifice 33 to the drain 22, thereby lowering the pressure inside the injection control chamber 3 until the pressure approaches atmospheric pressure. Then, the force acting on the needle 51 toward the injection control chamber 3 side becomes greater than the force toward the injection hole 23 side. As a result, the needle 51 is actuated and moved toward the injection control chamber 3 side, to thereby open the injection hole 23 (a valve-opening stroke), which allows injection of the fuel stored in the fuel storage 52 from the injection hole 23 into the unillustrated combustion chamber of an internal combustion engine. Because the fuel stored in the fuel storage 52 is pressurized by the pressure booster unit 100 as described above, the fuel increased in pressure by the pressure booster unit 100 can be injected.

When the fuel in the booster chamber 103 is pressurized by the booster piston 10, the fuel supply check valve 62 prevents a flow of fuel flowing out from the booster chamber 103 to the booster control chamber 102. In addition, because connection between the booster chamber 103 and the injection control chamber 3 is not provided, both outflow of fuel from the booster chamber 103 to the injection control chamber 3 and discharge of pressurized fuel into the drain 22 are disabled. Thus, the fuel in the booster chamber 103 pressurized by the booster piston 10 can be directed only toward pressurization of the fuel stored in the fuel storage 52, which can facilitate an efficient pressure increase of the fuel stored in the fuel storage 52 by means of the booster piston 10.

In the present embodiment, because both the fuel pressure inside the booster control chamber 102 and that inside the injection control chamber 3 are controlled by means of the common control valve 9, the needle 51 is actuated concurrently with actuation of the booster piston 10. Accordingly, while reduction in pressure of the fuel in the injection control chamber 3 is not performed, there can be prevented movement of the needle 51 toward the injection control chamber 3 side by the increased pressure of the fuel in the fuel storage 52, which would result in opening of the injection hole 23.

When the booster piston 10 is actuated and moved toward the booster chamber 103 side, the capacity of the back pressure chamber 104 is increased. However, because the back pressure chamber 104 communicates with the external drain 22, outside atmospheric pressure is introduced into the back pressure chamber 104. Consequently, the back pressure chamber 104 is maintained at atmospheric pressure, thereby preventing the pressure of the back pressure chamber 104 from becoming lower than the atmospheric pressure (a negative pressure). Thus, occurrence of cavitation or erosion due to the negative pressure is prevented.

In order to stop the injection of fuel, the control valve 9 is switched from the second state to the first state. When the control valve 9 is switched to the first state, the common rail pressure is introduced into the booster control chamber 102. Then, because the force (Fb3+Fb4) exerted on the booster piston 10 toward the pressurization chamber 101 side by the fuel pressure exceeds the force (Fb1+Fb2) exerted toward the booster chamber 102 side, the booster piston 10 moves to the pressurization chamber 101 side, and returns to the initial position thereof.

In addition, when the control valve 9 is switched to the first state, the common rail pressure is supplied via the injection control chamber orifice 33 into the injection control chamber 3, and at the same time is also supplied via the fuel supply orifice 61 into the fuel storage 52. Because the needle 51 is receiving the force exerted toward the injection hole 23 side by the valve-closing needle spring 53, the force acting on the needle 51 toward the injection hole 23 side becomes greater than that toward the injection control chamber 3 side. Because of this, the needle 51 is caused to move toward the injection hole 23 side, thereby closing the injection hole 23 (a valve-closing stroke), so that the injection of fuel is terminated.

In the valve-closing stroke of the needle 51 to close the injection hole 23, fuel pressure is supplied from the common accumulator 2 via the injection control chamber orifice 33 into the injection control chamber 3, and supplied from the common accumulator 2 via the fuel supply orifice 61 into the fuel storage 52 as well. In the present embodiment, because the channel area A1 in the fuel supply orifice 61 is smaller than the channel area A2 in the injection control chamber orifice 33, the amount of inflow of fuel into the fuel storage 52 becomes smaller than that into the injection control chamber 3. From this relationship, fuel pressure is supplied from the common accumulator 2 to the fuel storage 52 and the injection control chamber 3 in such a manner that the pressure of supplying fuel to the fuel storage 52 is lower than the pressure of supplying fuel to the injection control chamber 3 during the valve-closing stroke. Therefore, the force acting on the needle 51 toward the injection hole 23 side during the valve-closing stroke can be increased, to thereby enhance a travel speed (a valve-closing speed) of the needle 51 toward the injection hole 23 side.

Because fuel is supplied from the common accumulator 2 via the fuel supply orifice 61 to the booster chamber 103 during return action of the booster piston 10, the fuel pressure inside the booster chamber 103 becomes lower than both the fuel pressure inside the booster control chamber 102 and the fuel pressure inside the pressurization chamber 101, thereby weakening the force Fb4 acting on the booster piston 10 (the one end of the minor diameter portion 10-2) toward the pressurization chamber 101 side. However, depending on the settings of the areas B1 to B4, the condition that the force (Fb3+Fb4) exerted toward the pressurization chamber 101 side by fuel pressure is greater than the force (Fb1+Fb2) toward the booster chamber 103 side can be reliably maintained.

In order to return the booster piston 10 to the initial position, it is necessary that the following expression (1) be satisfied:

$$Fb3+Fb4>Fb1+Fb2 \quad (1)$$

In expression (1), Fb2 is extremely small in comparison with the other values, and can be ignored. Taking the common rail pressure as Pc and a pressure drop caused by the fuel supply orifice 61 as Ploss, the following expression (2) is obtained:

$$Pc\times B3+(Pc-Ploss)\times B4>Pc\times B1 \quad (2)$$

Through modification of expression (2), the following expression (3) is obtained:

$$Ploss<(B3+B4-B1)\times Pc/B4 \quad (3)$$

When Ploss, B1, B3, and B4 are set so as to satisfy the above expression (3), the force for returning the booster piston 10 to the initial position can be generated, to thereby enable reliable returning of the booster piston 10 to the initial position.

In addition, as the booster piston 10 moves toward the pressurization chamber 101 side to restore the initial position, the capacity of the back pressure chamber 104 decreases. However, because the back pressure chamber 104 communicates with the external drain 22, the fuel in the back pressure chamber 104 is drained out as the capacity of the back pressure chamber 104 decreases. Thus, the back pressure chamber 104 is maintained at atmospheric pressure, which can prevent an increase in pressure due to the decreased capacity of the back pressure chamber 104.

Next will be described results of analysis conducted by the inventor of the present application.

Figure 3:
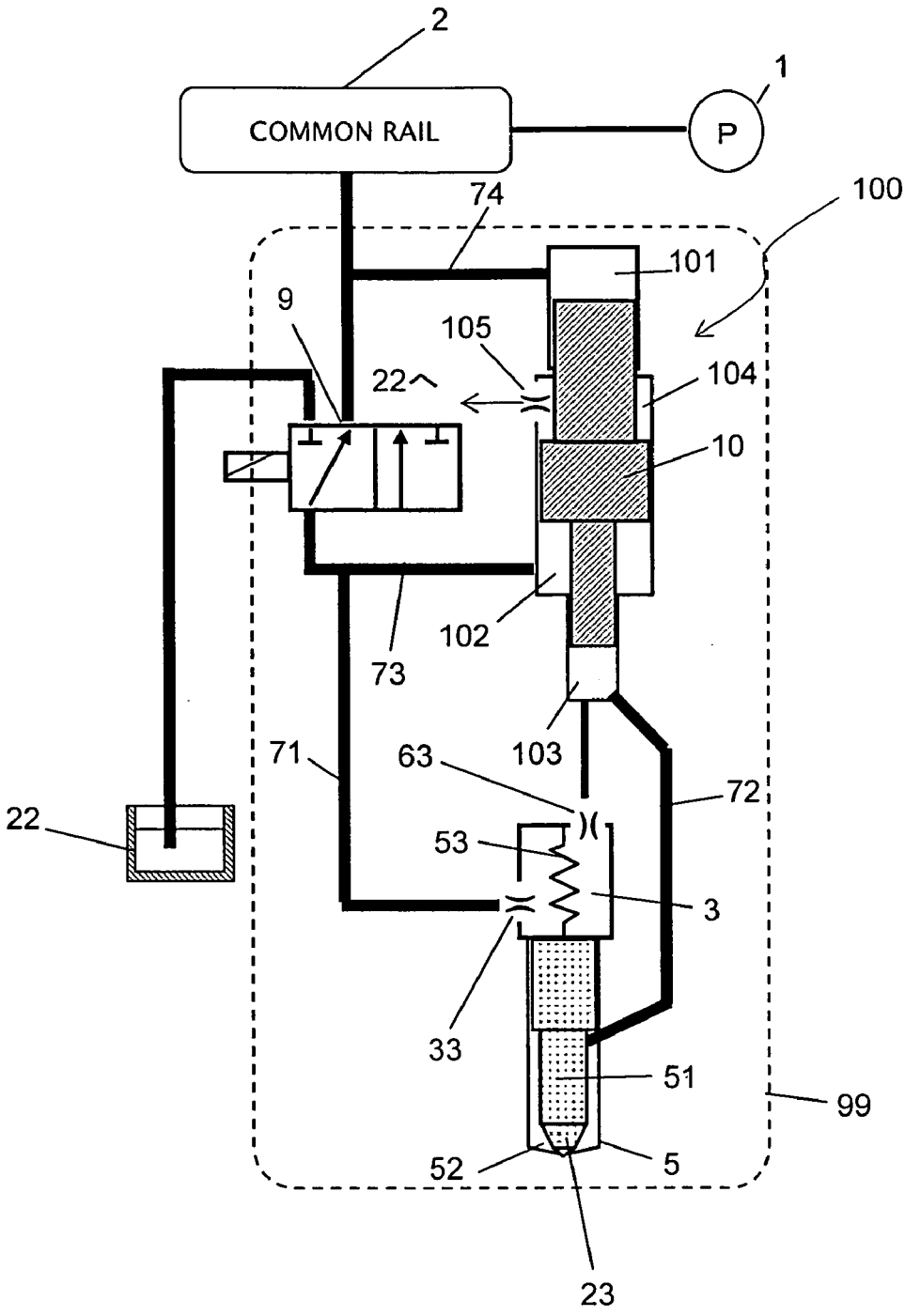
Figure 4:
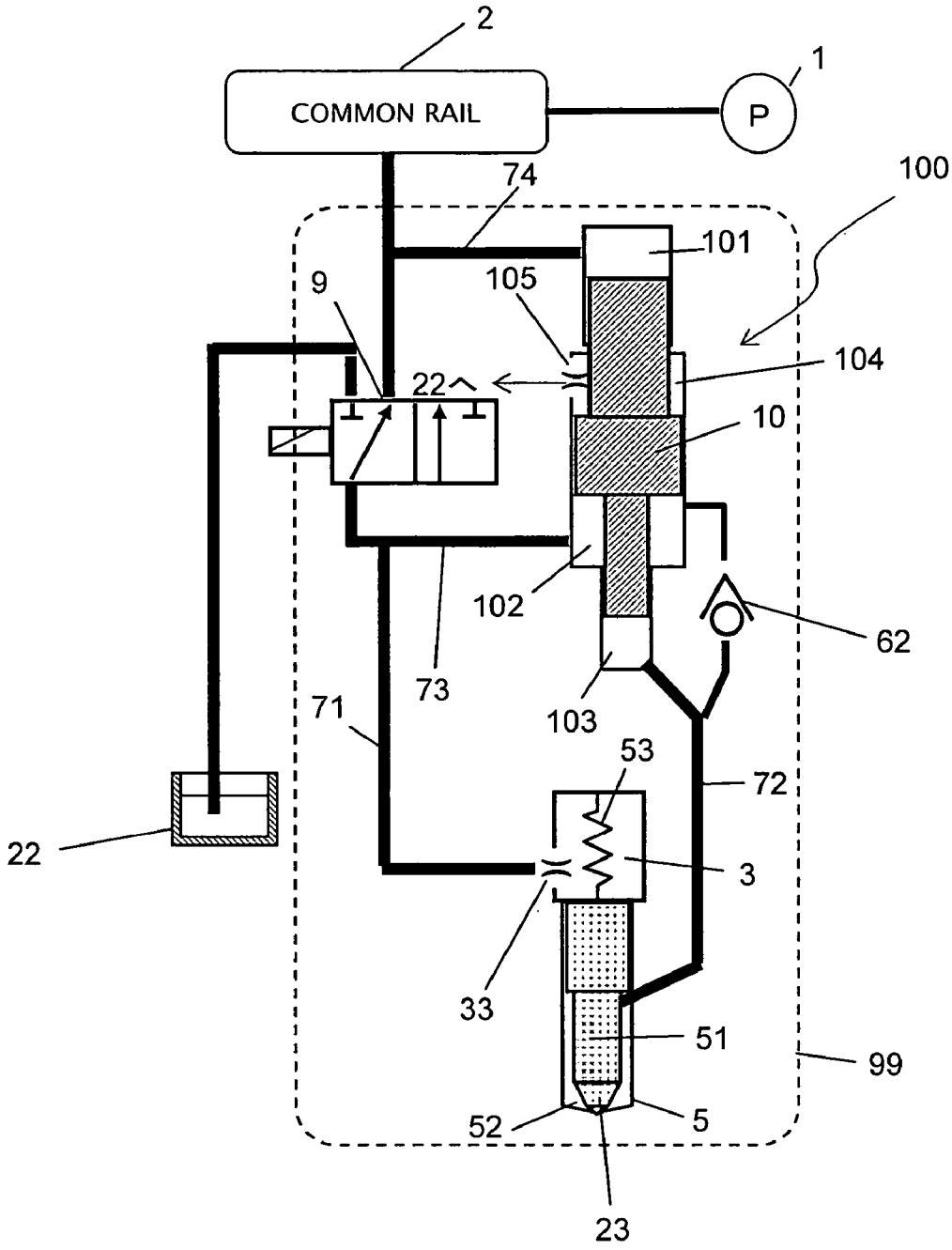
Figure 5:
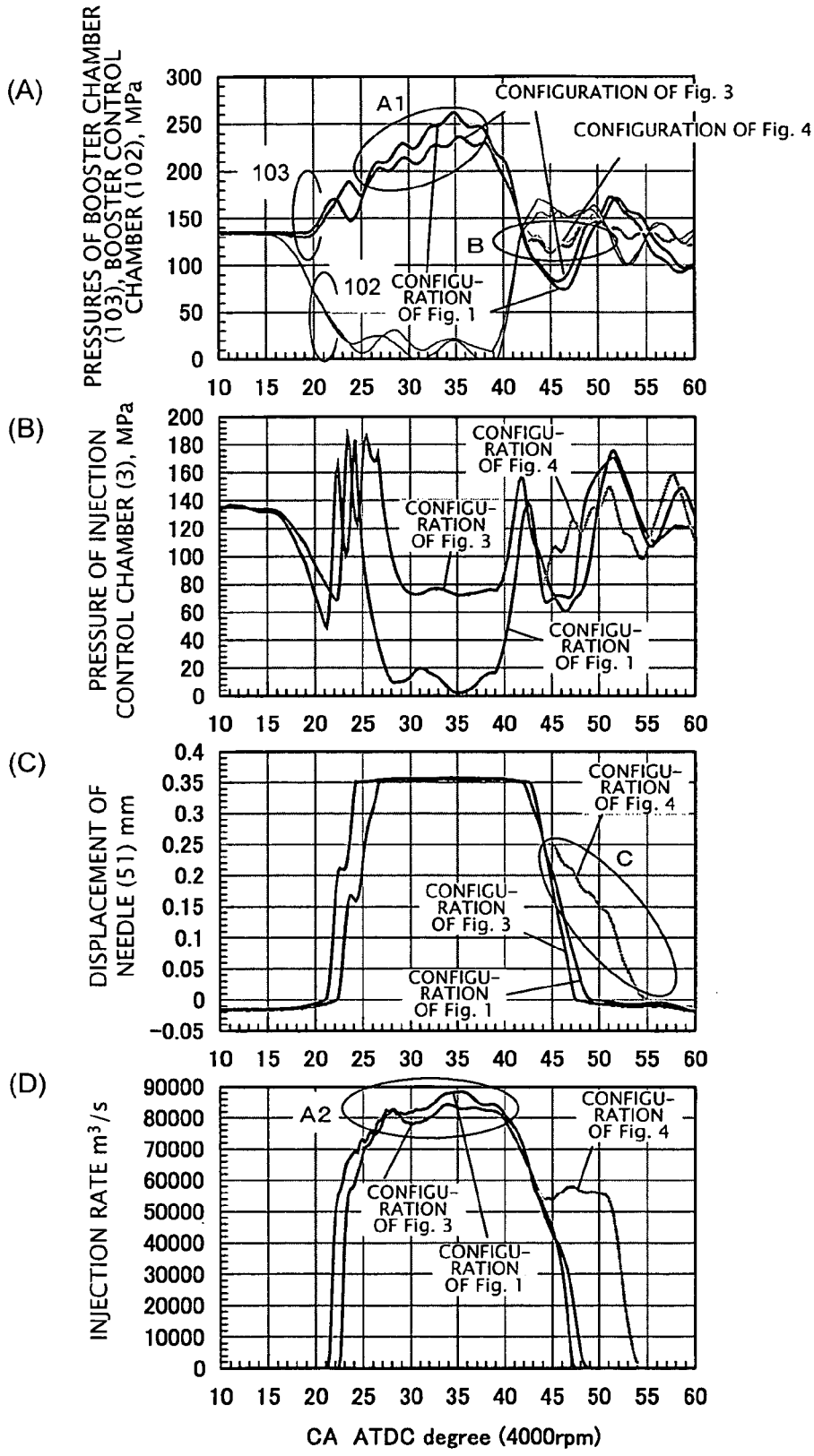

Analytical models of the fuel injection devices configured as depicted in FIGS. 1, 3, and 4 were used to calculate the pressures of the booster control chamber 102, the booster chamber 103, and the injection control chamber 3, displacement of the needle 51, and fuel injection rates. The calculation result is shown in FIG. 5. Specifically, FIG. 5(A) shows waveforms of the pressures of the booster control chamber 102 and the booster chamber 103 with respect to a crank angle, FIG. 5(B) shows waveforms of the pressure of the injection control chamber 3 with respect to the crank angle, FIG. 5(C) shows waveforms of displacement of the needle 51 with respect to the crank angle, and FIG. 5(D) shows waveforms of fuel injection rate ($mm^3/s$) with respect to the crank angle.

In contrast to the configuration shown in FIG. 1, the configuration shown in FIG. 3 has the booster chamber 103 connected via the fuel supply orifice (throttle section) 63 to the injection control chamber 3, and in the configuration of FIG. 3, fuel pressure is supplied from the injection control chamber 3 via the fuel supply orifice 63 to both the booster chamber 103 and the fuel storage 52. Further, in addition to lack of the fuel supply orifice 61 and fuel supply check valve 62, the conduit for connecting the booster control chamber 102 with the booster chamber 103 is not disposed. Meanwhile, in contrast to the configuration shown in FIG. 1, the configuration shown in FIG. 4 does not have the fuel supply orifice 61.

In analysis for each configuration, the booster piston 10 is set to specifications of B1=1.96×B4, B2=0.11×B4, and B3=1.07×B4, and the inside diameter of the injection control chamber orifice 33 is set to 0.36 mm while the inside diameter of the fuel supply orifices 61, 63 are set to 0.1 mm. Further, the pressure inside the common accumulator 2 (the common rail pressure) is set to 135 MPa.

In the configuration shown in FIG. 3, because the fuel pressure is, in the valve-closing stroke, supplied from the injection control chamber 3 via the fuel supply orifice 63 to the fuel storage 52, the flow amount flowing into the fuel storage 52 is smaller than that flowing into the injection control chamber 3. Therefore, also in the configuration shown in FIG. 3, the fuel pressure is supplied, in the valve-closing stroke, from the common accumulator 2 to both the fuel storage 52 and the injection control chamber 3 in such a manner that the pressure of supplying fuel to the fuel storage 52 becomes lower than the pressure of supplying fuel to the injection control chamber 3. In this manner, because, as shown in region B of FIG. 5(A), the fuel pressure in the booster chamber 103 (the fuel storage 52) can be reduced to a greater extent than in the configuration of FIG. 4 during the valve-closing stroke, the force acting on the needle 51 toward the injection hole 23 side can be increased, which in turn enables, as shown in region C of FIG. 5(C), greater enhancement of the valve-closing speed of the needle 51 than that realized in the configuration shown in FIG. 4.

However, in the configuration of FIG. 3, the fuel in the booster chamber 103 pressurized by the booster piston 10 is not only supplied to the fuel storage 52 but is also supplied to the injection control chamber 3 via the fuel supply orifice 63. Therefore, as shown in region A1 of FIG. 5(A), the pressure inside the booster chamber 103 is reduced during an injection period to a greater extent than it is reduced in the configurations shown in FIGS. 1 and 4, and consequently the maximum injection rate is lower than that attained in the configurations of FIGS. 1 and 4 as shown in region A2 of FIG. 5(D).

Further, in the configuration shown in FIG. 4, the fuel in the booster chamber 103 pressurized by the booster piston 10 can be applied only to increasing the pressure of fuel stored in the fuel storage 52. Thus, as shown in region A1 of FIG. 5(A), during the injection period the booster chamber 103 can be maintained at a pressure higher than that maintained in the configuration shown in FIG. 3, to thereby yield an effect that the maximum injection rate can be maintained during the injection period at a level higher than that of the configuration shown in FIG. 3 as shown in region A2 of FIG. 5(D).

However, in the configuration shown in FIG. 4, as shown in region B of FIG. 5(A), the fuel pressure of the booster chamber 103 (the fuel storage 52) cannot be suppressed during the valve-closing stroke, which results in the lowering of the force acting on the needle 51 toward the injection hole 23 side, and accordingly causes the valve-closing speed of the needle 51 to become slower than that realized in the configurations shown in FIGS. 1 and 3 as shown in region C of FIG. 5(C).

In the configuration shown in FIG. 1, because suppression in the fuel pressure of the booster chamber 103 (the fuel storage 52) is greater than that in the configuration shown in FIG. 4 during the valve-closing stroke as shown in region B of FIG. 5(A), the force acting on the needle 51 toward the injection hole 23 side can be enhanced, to thereby yield, as shown in region C of FIG. 5(C), the valve-closing speed of the needle 51 faster than that obtained in the configuration of FIG. 4. Further, because the configuration shown in FIG. 1 is capable of directing the fuel in the booster chamber 103 pressurized by the booster piston 10 toward only increasing the pressure of the fuel stored in the fuel storage 52, the booster chamber 103 can be maintained at a pressure higher than that maintained in the configuration of FIG. 3 during the injection period as shown in region A1 of FIG. 5(A), whereby the maximum injection rate is maintained at a level higher than that of the configuration of FIG. 3 during the injection period as shown in region A2 of FIG. 5(D).

As described above, because the force acting on the needle 51 toward the injection hole 23 side can be enhanced during the valve-closing stroke to thereby accelerate the valve-closing speed of the needle 51, the fuel injection device according to the present embodiment can realize excellent performance of terminating the injection. Accordingly, superior state of atomization of the injected fuel can be realized, thereby achieving stable combustion.

Further, according to the present embodiment, even when the fuel pressure inside the booster chamber 103 is reduced in the course of returning the booster piston 10 to the initial position, there can be reliably maintained the condition that the force (Fb3+Fb4) acting on the booster piston 10 toward the pressurization chamber 101 side is greater than the force (Fb1+Fb2) toward the booster chamber 103 side. Therefore, the booster piston 10 can be reliably returned to the initial position.

Still further, according to the present embodiment, there can be prevented draining out of the fuel pressurized by the booster piston 10 through the injection control chamber 3 into the drain 22, thereby allowing the pressurized fuel in the booster chamber 103 to be directed toward only increasing the pressure of fuel stored in the fuel storage 52. In this way, operation of injecting the fuel pressurized by the booster piston 10 can be performed with efficiency.

(2) Embodiment 2

Figure 6:
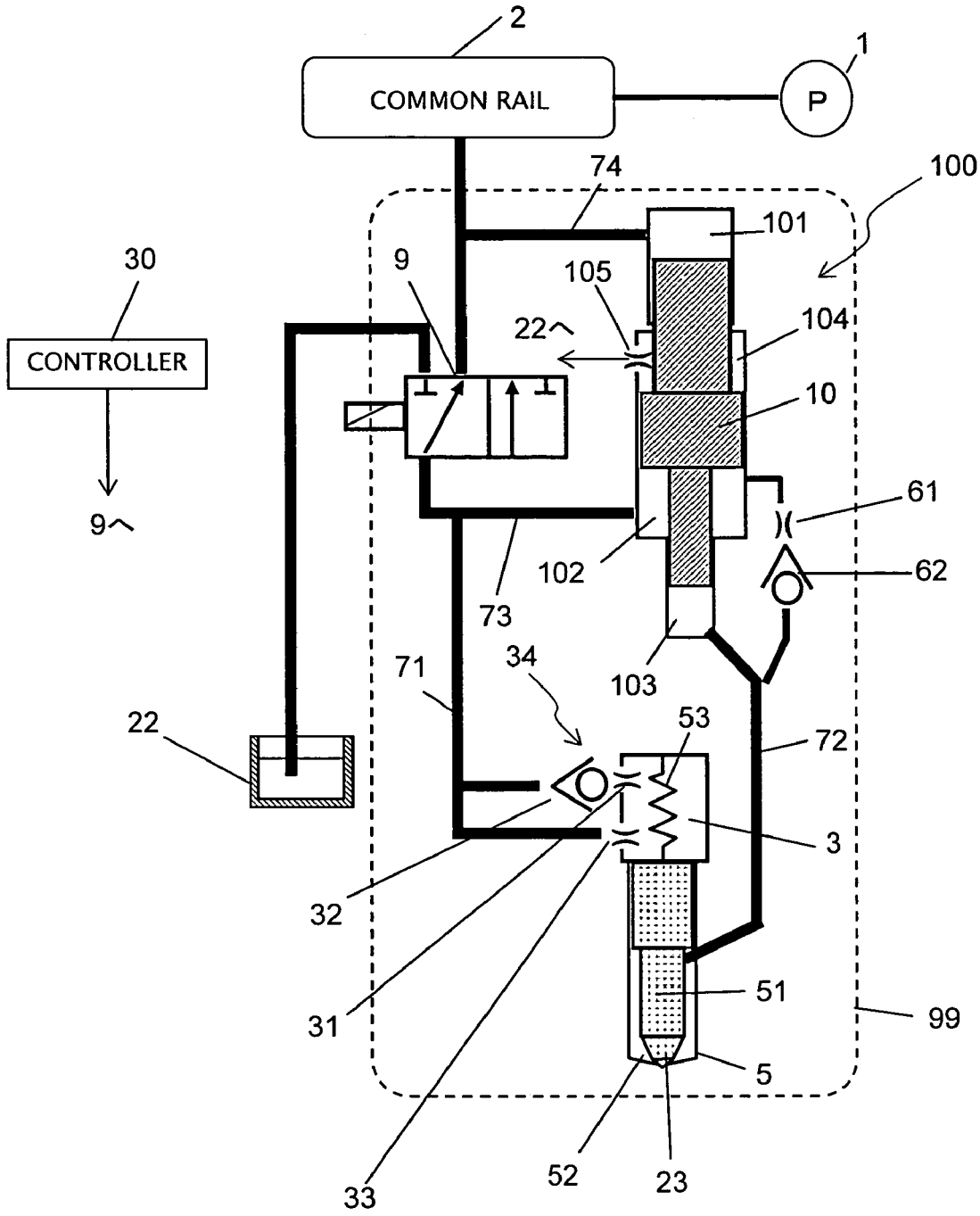
FIG. 6 is a schematic diagram showing a configuration of a fuel injection device according to a second embodiment of the present invention.

FIG. 6 is a schematic diagram showing a configuration of a fuel injection device according to Embodiment 2 the present invention. In this embodiment, a one-way orifice 34 is disposed, as distinct from the configuration shown in FIG. 1, between the control valve 9 and the injection control chamber 3.

The one-way orifice 34 consists of an injection rate control orifice (throttle section) 31, an injection rate control check valve (non-return valve) 32, and an injection control chamber orifice (throttle section) 33. The injection rate control orifice 31 and the injection control chamber orifice 33 are disposed in parallel to each other at inlet and outlet ports of the injection control chamber 3. The injection rate control check valve 32 is disposed in series with the injection rate control orifice 31, to allow a flow of fuel from the control valve 9 to the injection control chamber 3 while blocking a flow of fuel from the injection control chamber 3 to the control valve 9. The injection rate control orifice 31 may be integrally formed in the injection rate control check valve 32. By the one-way orifice 34 configured as described above, the area of a channel through which fuel flows from the injection control chamber 3 to the control valve 9 is made smaller than that of a channel through which fuel flows from the control valve 9 to the injection control chamber 3.

In the present embodiment, a channel area A1 in the fuel supply orifice 61, a channel area A2 in the injection control chamber orifice 33, and a channel area A3 in the injection rate control orifice 31 are established in such a manner that the channel area A1 is smaller than the sum of the channel area A2 and the channel area A3. Other structures are identical to those of Embodiment 1 shown in FIG. 1, and description thereof is not repeated.

Next, operation of the fuel injection device according to the present embodiment will be described.

When the control valve 9 is switched from the first state to the second state for injecting fuel, the injection control chamber 3 is connected via the injection control chamber orifice 33 in the one-way orifice 34 to the drain 22, which causes the pressure inside the injection control chamber 3 to decrease until it approaches atmospheric pressure. As a result, the needle 51 is actuated and moved toward the injection control chamber 3 side, thereby opening the injection hole 23 (the valve-opening stroke). However, the outflow of fuel through the injection rate control orifice 31 is blocked by the injection rate control check valve 32. On the other hand, when the control valve 9 is switched from the second state to the first state to terminate the injection of fuel, the common rail pressure is supplied, via the injection rate control orifice 31 and the injection control chamber orifice 33 which are arranged in parallel to each other in the one-way orifice 34, into the injection control chamber 3, which causes the needle 51 to move toward the injection hole 23 side to thereby close the injection hole 23 (valve-closing stroke). As such, in the present embodiment, the outflow of fuel through the injection rate control orifice 31 is blocked during the valve-opening stroke of the needle 51 to open the injection hole 23, whereas the inflow of fuel through the injection rate control orifice 31 is allowed during the valve-closing stroke of the needle 51 to close the injection hole 23. Thus, the flow amount of fuel flowing out from the injection control chamber 3 during the valve-opening stroke becomes smaller than the flow amount of fuel flowing into the injection control chamber 3 during the valve-closing stroke.

Further, in the present embodiment, the controller 30 controls the fuel pressure in the fuel storage 52 at a time when the booster piston 10 is actuated through the regulation of the fuel pressure inside the common accumulator 2, to thereby enable control of the fuel injection rate during the valve-opening stroke. The control of the fuel injection rate during the valve-opening stroke will be described in detail below.

In low-load operation of an internal combustion engine, the controller 30 controls the fuel pressure in the common accumulator 2 such that the fuel injection rate is reduced to a predetermined injection rate or lower during the valve-opening stroke. Here, the predetermined injection rate is established so as to obtain injection rate characteristics in which an initial injection rate is suppressed; i.e., characteristics of so-called delta injection rate. With this setting, a lift speed of the needle 51 during the valve-opening stroke (the valve-opening speed) can be suppressed in the low-load operation of an internal combustion engine, to thereby enable reduction in the fuel injection rate during the valve-opening stroke, which in turn makes it possible to obtain the characteristics of delta injection rate in which the initial injection rate is suppressed. Thus, suppression of NOx and reduction of combustion noise can be realized. Because, in addition to flowing through the injection control chamber orifice 33, fuel flows through the injection rate control orifice 31 into the injection control chamber 3 during the valve-closing stroke, a valve-closing speed of the needle 51 can be increased so that excellent termination of injection can be secured. Therefore, a superior state of atomization of injected fuel can be obtained, thereby leading to achievement of stable combustion.

However, in the present embodiment, because the flow amount of fuel flowing out from the injection control chamber 3 during the valve-opening stroke is smaller than the flow amount of fuel flowing into the injection control chamber 3 during the valve-closing stroke, it will be difficult to secure high power of an internal combustion engine when the fuel injection rate in the valve-opening stroke is suppressed during high-load operation of the internal combustion engine. With this in view, the controller 30 controls the fuel pressure in the common accumulator 2 during the high-load operation of the internal combustion engine so as to compensate for a reduction in the fuel injection rate during the valve-opening stroke resulting from the condition that the flow amount of fuel flowing out from the injection control chamber 3 is smaller than that flowing into the injection control chamber 3. Here, the fuel pressure in the common accumulator 2 (the common rail pressure) is controlled such that injection rate characteristics in which a high injection rate can be obtained in an early stage without suppressing the initial injection rate; i.e., the characteristics of so-called rectangular injection rate.

Because the force pushing the booster piston 10 toward the booster chamber 103 side when the booster piston 10 is actuated increases with increasing common rail pressure, a travel speed of the booster piston 10 upon the actuation increases also with the increasing common rail pressure. Hence, the higher the common rail pressure, the more quickly the pressure in the fuel storage 52 will increase during the initial phase of injection. For the needle 51, the lift speed of the needle 51 increases as the pressure inside the injection control chamber 3 decreases in relation to the pressure inside the fuel storage 52. When the pressure inside the fuel storage 52 quickly increases because of the high common rail pressure, the fuel pressure inside the fuel storage 52 having no escape for fuel is raised still further by pressurization even though the lift speed of the needle 51 is suppressed as a result of reduction in the flow amount of fuel flowing out from the injection control chamber 3. By the above-described action, during the high-load operation of an internal combustion engine, the reduction in the fuel injection rate in the valve-opening stroke can be compensated by increasing the common rail pressure to a greater extent than during the low-load operation, so that the characteristics of rectangular injection rate can be obtained. Hence, the high power of the internal combustion engine can be secured. Further, the valve-closing speed of the needle 51 can be accelerated in the valve-closing stroke similar to that during the low-load operation, to thereby secure excellent termination of injection.

As described above, the controller 30 can realize the characteristics of delta injection rate during the low-load operation while realizing the characteristics of rectangular injection rate during the high-load operation by increasing the fuel pressure in the common accumulator 2 (the common rail pressure) as the load of an internal combustion engine increases. Other actions are similar to those described in Embodiment 1, and description thereof is not repeated.

Next, results of analysis conducted by the inventor of the present application will be described.

Figure 7:
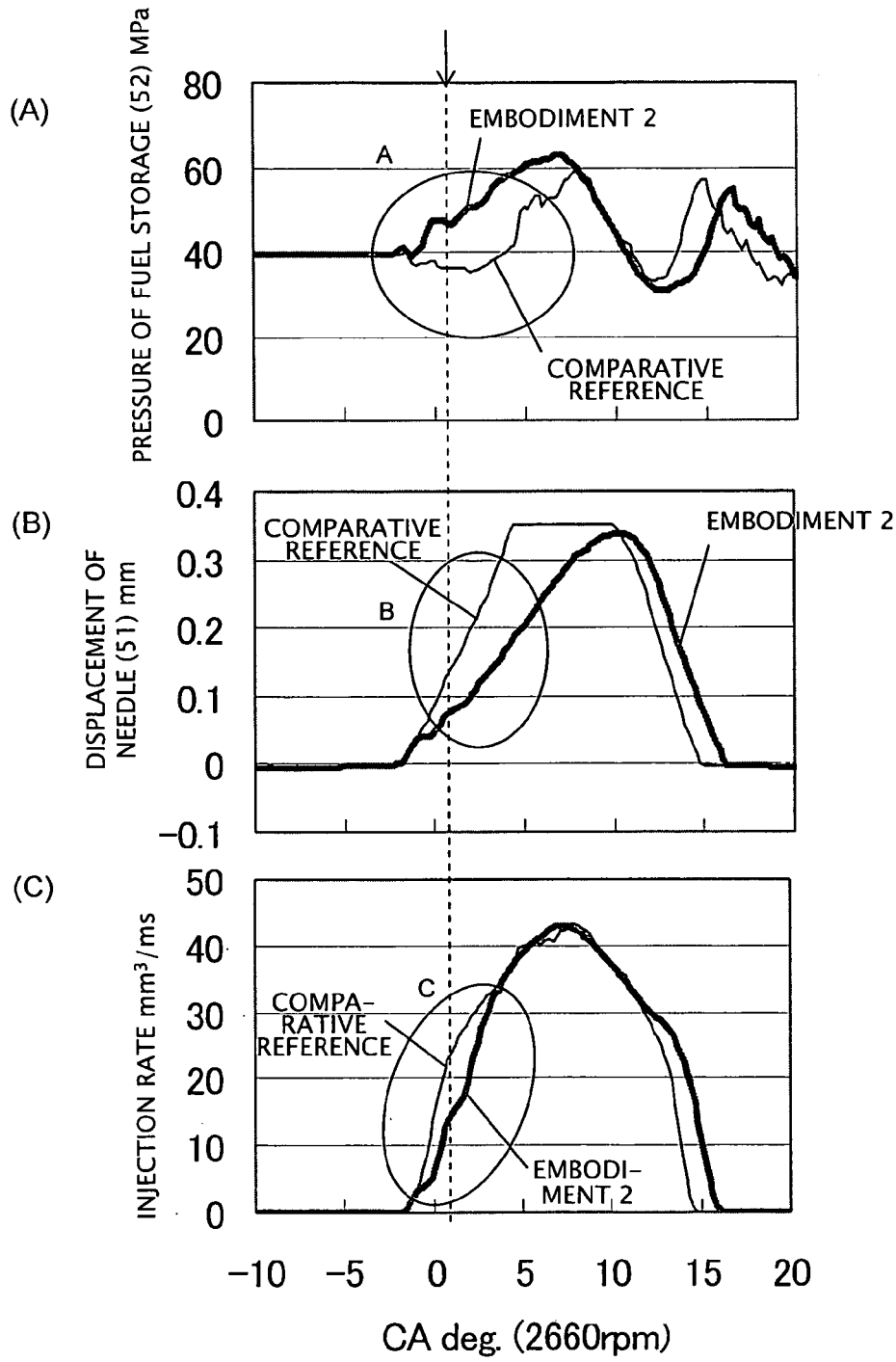
Figure 8:
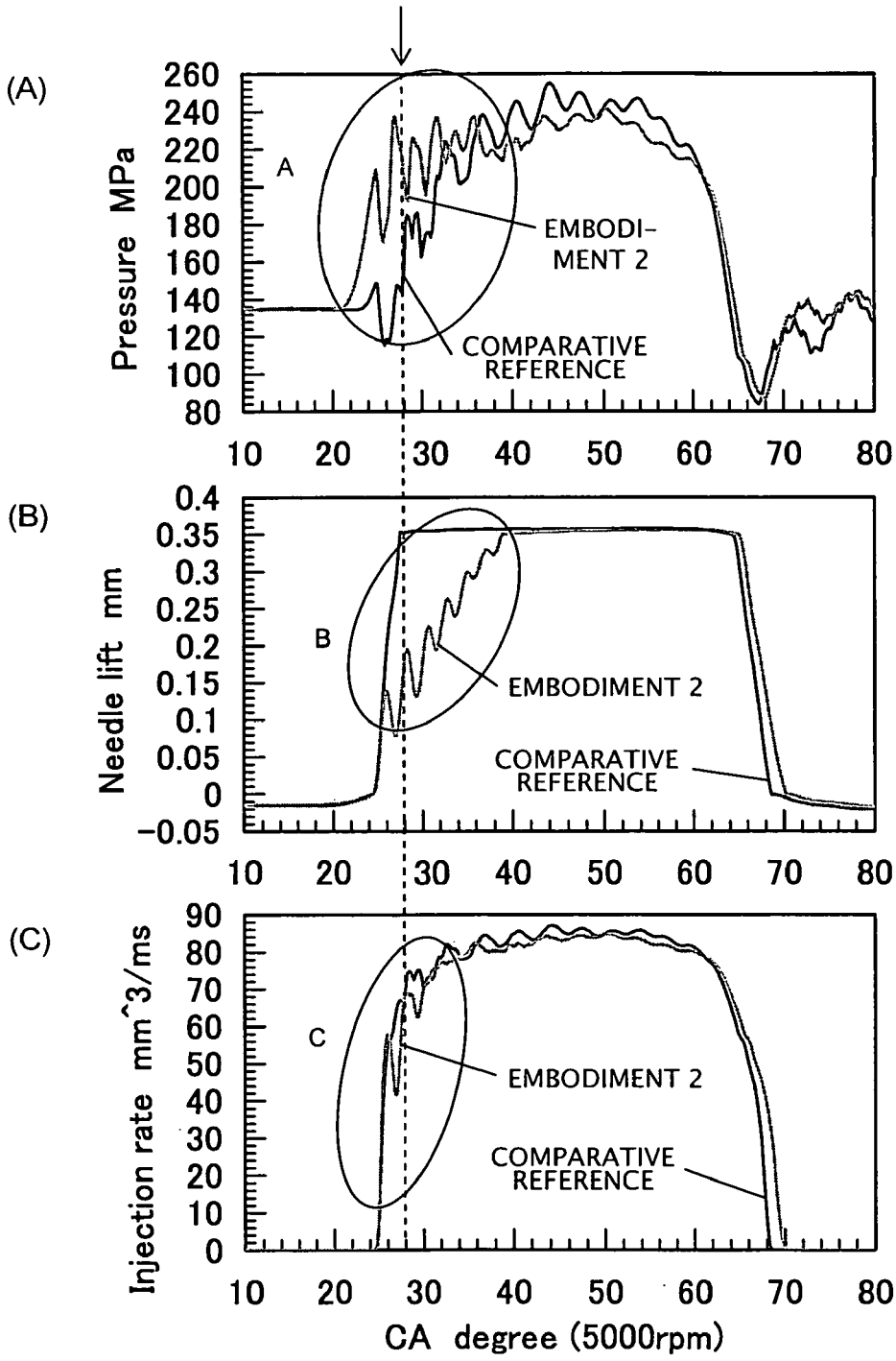

An analytic model of the fuel injection device having the configuration depicted in FIG. 6 was used to calculate the pressure of the fuel storage 52, the displacement of the needle 51, and the fuel injection rate. The result of calculation is shown in FIGS. 7 and 8. Here, FIG. 7 shows the result of calculation for partial-load operation, and FIG. 8 shows the result of calculation for full-load operation. Specifically, FIGS. 7(A) and 8(A) show waveforms of the pressure of the fuel storage 52 with respect to the crank angle, FIGS. 7(B) and 8(B) show waveforms of the displacement of the needle 51 with respect to the crank angle, and FIGS. 7(C) and 8(C) show waveforms of the fuel injection rate ($mm^3$/ms) with respect to the crank angle. Further, as a comparative reference, the calculation was performed by means of another analytic model in which only the injection control chamber orifice 33 is disposed in place of the one-way orifice 34 (and the injection rate control orifice 31 and the injection rate control check valve 32 are removed).

In the analysis, the booster piston 10 is set to the following specifications: B1=1.96×B4, B2=0.11×B4, B3=1.07×B4. The common rail pressure, the engine speed, and the amount of fuel injected during the partial-load operation are set to 40 MPa, 2,660 rpm, and 30 $mm^3$, respectively, whereas the common rail pressure, the engine speed, and the amount of fuel injected during the full-load operation are set to 135 MPa, 5,000 rpm, and 110 $mm^3$, respectively. Further, in the analysis of the configuration shown in FIG. 6, the inside diameter of the injection rate control orifice 31 is set to 0.32 mm, and the inside diameter of the injection control chamber orifice 33 is set to 0.16 mm. In addition, in the analysis of the comparative reference, the inside diameter of the injection control chamber orifice 33 is set to 0.36 mm.

During the partial-load operation of the configuration shown in FIG. 6, the injection rate control check valve 32 is closed in the valve-opening stroke, thereby allowing fuel to flow out from the injection control chamber 3 through only the injection control chamber orifice 33. Because of this, the pressure inside the injection control chamber 3 decreases slowly in the valve-opening stroke, which causes the lift speed of the needle 51 to be slower than that of the comparative reference as shown in region B of FIG. 7(B). However, because the slowed lift speed of the needle 51 results in a smaller amount of fuel injected from the injection hole 23 in relation to the comparative reference, the pressure of the fuel storage 52 during the valve-opening stroke becomes higher than that of the comparative reference as show in region A of FIG. 7(A). During the partial-load operation in which the common rail pressure is low, however, because of greater suppression of the lift speed of the needle 51, the fuel injection rate during the valve-opening stroke is reduced to a greater extent than in the comparative reference as shown in region C of FIG. 7(C). Consequently, excellent characteristics of delta injection rate as shown in FIG. 7(C) can be realized during the partial-load operation of the configuration shown in FIG. 6, to thereby enable realization of suppressed NOx and reduced combustion noise.

Figure 9:
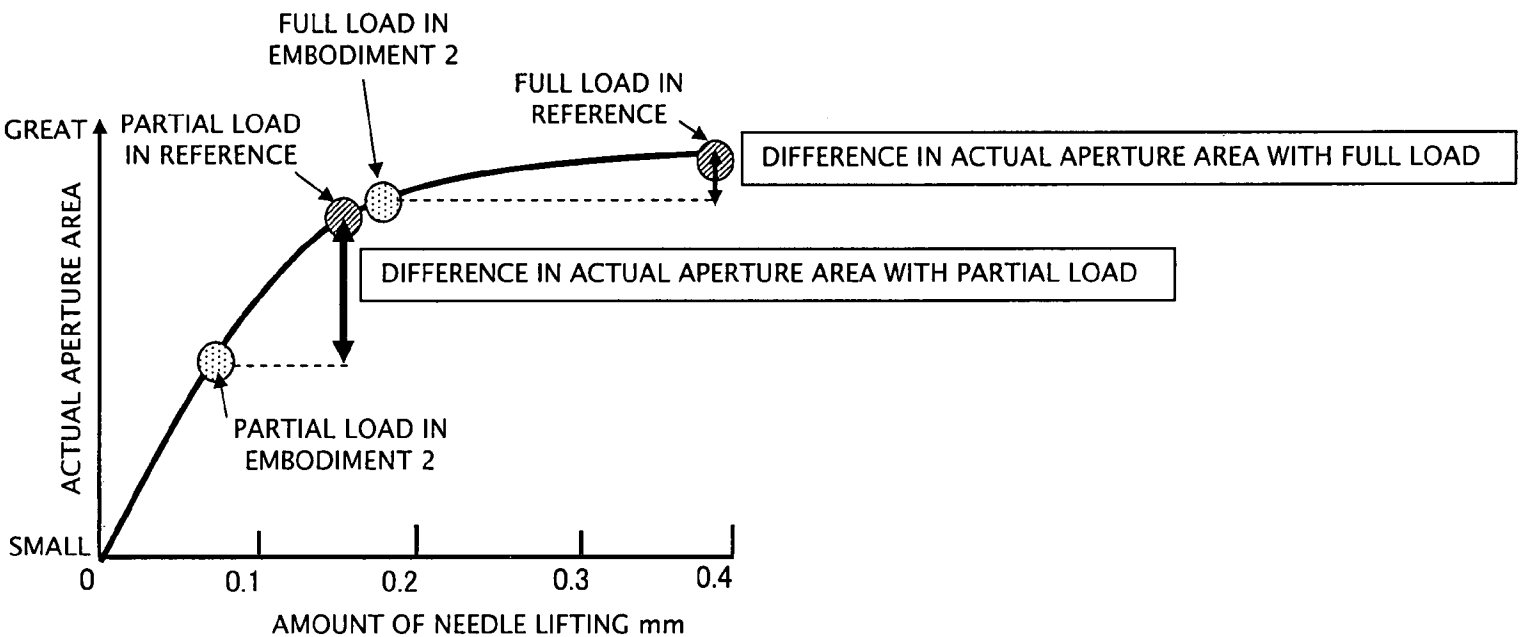
FIG. 9 is a diagram showing characteristics of an actual aperture area of a fuel injection nozzle.

During the full-load operation of the configuration shown in FIG. 6, the pressure of the injection control chamber 3 decreases slowly, similar to that during the partial-load operation, which causes the lift speed of the needle 51 in the valve-opening stroke to be slower than that of the comparative reference as shown in region B of FIG. 8(B). However, as shown in FIG. 9, because a change in an actual aperture area of the fuel injection nozzle 5 becomes smaller in regions where the amount of lifting of the needle 51 is greater, the fuel injection rate is more impervious to the effect of reducing the amount of lifting of the needle 51. In addition, an increase in the pressure of the fuel storage 52 resulting from a reduced amount of fuel injected from the injection hole 23 is greater during the full-load operation as compared to that during the partial-load operation. Referring to numerical values, at a time when the needle displacement in the initial phase of injection in the configuration shown in FIG. 6 becomes almost half the needle displacement in the comparative reference (shown by a down arrow "↓" in both FIG. 7 and FIG. 8), a rate of increase in the pressure of the fuel storage 52 is a 30% increase (from 37 MPa of the comparative reference to 48 MPa of the configuration shown in FIG. 6) during the partial-load operation, in contrast to a 40% increase (from 150 MPa of the comparative reference to 210 MPa of the configuration shown in FIG. 6) during the full-load operation. By virtue of the above-described action, the effect resulting from the increased pressure of the fuel storage 52 is great during the full-load operation in which the common rail pressure is high, and, as shown in region C of FIG. 8(C), the fuel injection rate in the valve-opening stroke is not reduced to such an extent that it is reduced during the partial-load operation even when the lift speed of the needle 51 is suppressed. Therefore, during the full-load operation of the configuration shown in FIG. 6, the characteristics of rectangular injection rate substantially identical to those of the comparative reference can be secured as shown in FIG. 8(C), which in turn makes it possible to secure the high power of the internal combustion engine.

As described above, in addition to the capability of realizing excellent termination of injection, in the present embodiment, operation of injecting the fuel pressurized by the booster piston 10 can be performed with high efficiency. Further, in the present embodiment, because the characteristics of delta injection rate in which the initial injection rate is suppressed can be realized during the high-load operation of an internal combustion engine, it is possible to realize both suppression of NOx and reduction of combustion noise. Meanwhile, because the characteristics of rectangular injection rate in which the high injection rate can be obtained in the early stage can be realized during the high-load operation of an internal combustion engine, the high power of the internal combustion engine can be secured. As such, according to the present embodiment, the characteristics of the fuel injection rate can be changed appropriately in accordance with an operation state of the internal combustion engine.

A modification of the present embodiment will be described below.

Figure 10:
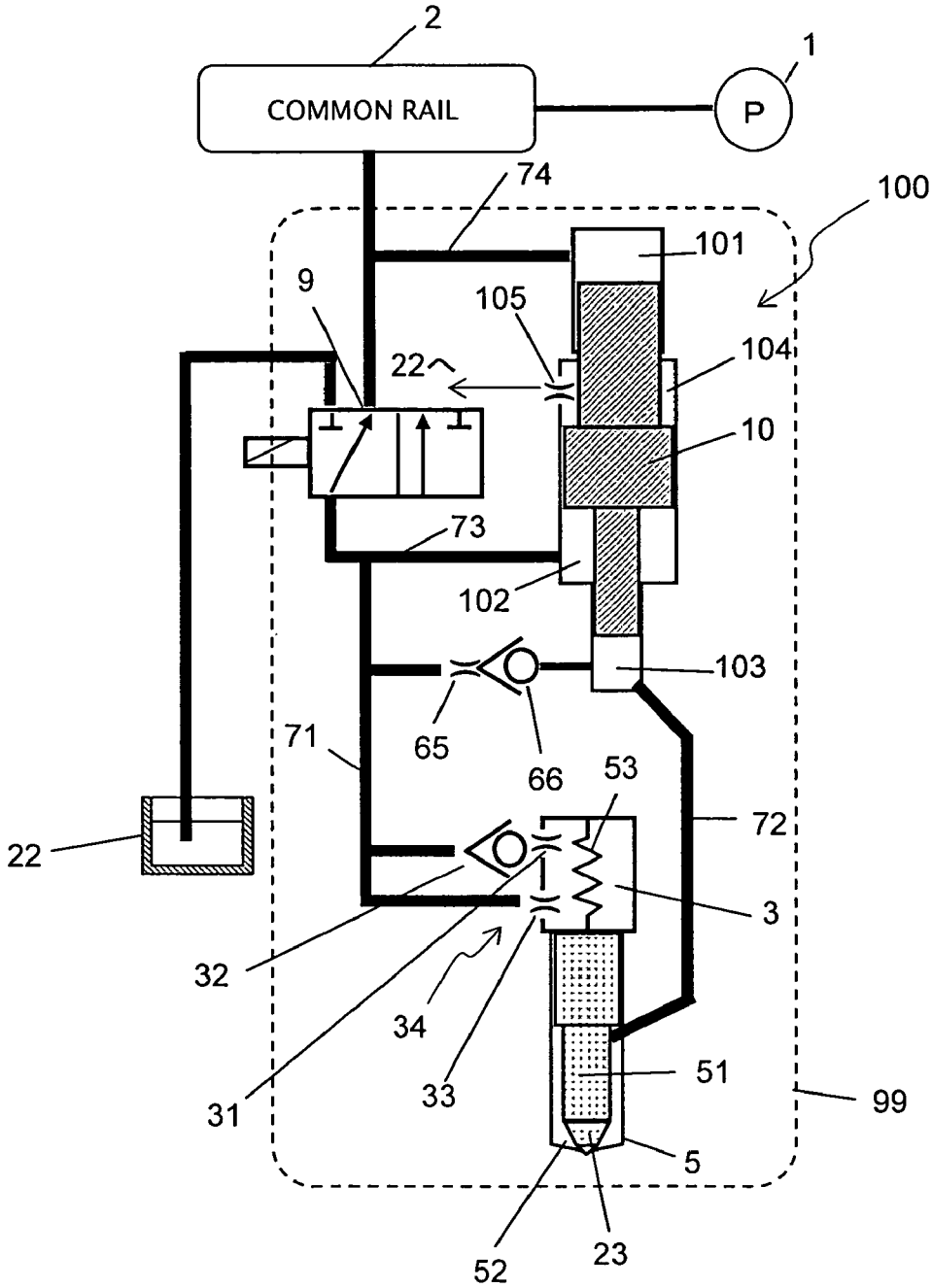
FIG. 10 is a schematic diagram showing another configuration of the fuel injection device according to the embodiment of the present invention.

As compared with the configuration shown in FIG. 6, the configuration shown in FIG. 10 is provided with a fuel supply orifice (throttle section) 65 and a fuel supply check valve (non-return valve) 66 rather than the fuel supply orifice 61 and the fuel supply check valve 62. The booster chamber 103 is connected to the booster control chamber 102 via the fuel supply check valve 66, the fuel supply orifice 65, and the conduit 73. In addition, the booster chamber 103 is also connected to the injection control chamber 3 via the fuel supply check valve 66, the fuel supply orifice 65, the conduit 71, and the one-way orifice 34. The fuel supply check valve 66 used here allows both flow of fuel from the booster control chamber 102 and flow of fuel from the injection control chamber 3 to the booster chamber 103, while blocking both flows of fuel from the booster chamber 103 to the booster control chamber 102 and to the injection control chamber 3. The fuel supply orifice 65 may be integrally formed in the fuel supply check valve 66. Further, the channel area A4 in the fuel supply orifice 65 is made smaller than the sum of the channel area A2 in the injection control chamber orifice 33 and the channel area A3 in the injection rate control orifice 31.

Also in the configuration shown in FIG. 10, the force acting on the needle 51 toward the injection hole 23 side can be increased during the valve-closing stroke, to thereby enable excellent termination of injection. Further, because the fuel pressurized by the booster piston 10 is prevented from being drained out through the injection control chamber 3 to the drain 22, the operation of injecting the fuel pressurized by the booster piston 10 can be performed with high efficiency.

Figure 11:
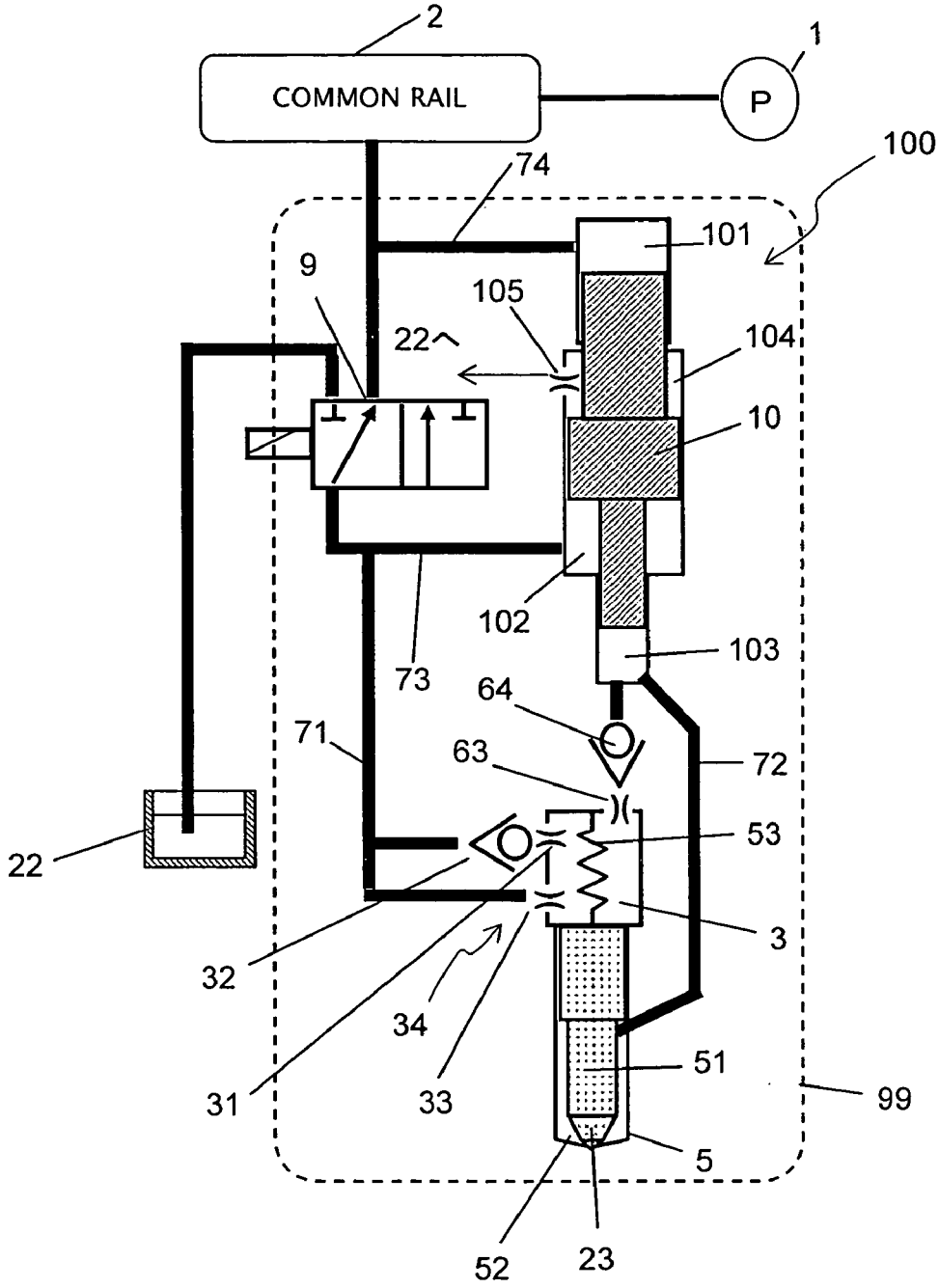
FIG. 11 is a schematic diagram showing still another configuration of the fuel injection device according to the embodiment of the present invention.
Figure 12:
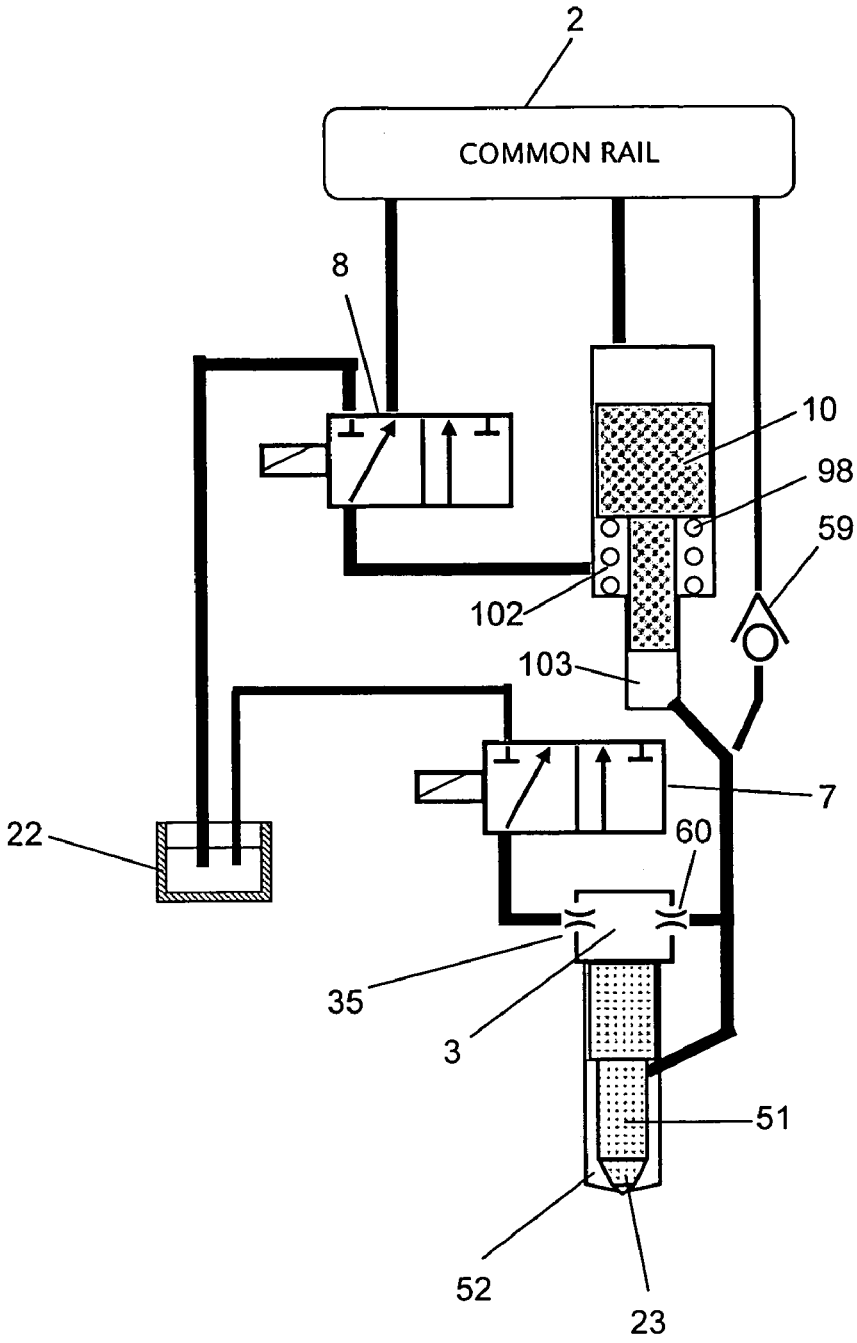
FIG. 12 is a schematic diagram showing a configuration of a related art fuel injection device.

Further, in a configuration shown in FIG. 11, as distinct from the configuration of FIG. 6, the fuel supply orifice (throttle section) 63 and the fuel supply check valve (non-return valve) 64 are provided rather than the fuel supply orifice 61 and the fuel supply check valve 62. In addition, the booster chamber 103 is connected via the fuel supply orifice 63 and the fuel supply check valve 64 to the injection control chamber 3. The fuel supply check valve 64 used here allows the flow of fuel from the injection control chamber 3 to the booster chamber 103, while blocking the flow of fuel from the booster chamber 103 to the injection control chamber 3. The fuel supply orifice 63 may be integrally formed in the fuel supply check valve 64.

In the configuration shown in FIG. 11, fuel pressure is supplied from the injection control chamber 3 via the fuel supply orifice 63 and the fuel supply check valve 64 to the fuel-storage 52 during the valve-closing stroke. With this configuration, the fuel pressure is supplied from the common accumulator 2 to the fuel storage 52 and the injection control chamber 3 during the valve-closing stroke in such a manner that the pressure of supplying fuel to the fuel storage 52 is lower than the pressure of supplying fuel to the injection control chamber 3. Consequently, the force acting on the needle 51 toward the injection hole 23 side can be increased, to thereby enable excellent termination of injection. Then, because the fuel supply check valve 64 can prevent the fuel pressurized by the booster piston 10 from being drained out through the injection control chamber 3 to the drain 22, the operation of injecting the fuel pressurized by the booster piston 10 can be performed with high efficiency.

It should be noted that in the configurations shown in FIGS. 10 and 11, the injection control chamber orifice 33 may be installed in place of the one-way orifice 34.

Although several forms for embodying the present invention have been described, it is to be understood that the invention is not limited to the described forms, and may be embodied in various forms without departing from the spirit and scope of the invention.

The invention claimed is:

1. A fuel injection device comprising:

a fuel injection unit having a fuel storage for storing fuel supplied from a fuel supply source, a needle for opening and closing an injection hole from which the fuel stored in the fuel storage is injected, and an injection control chamber in which fuel pressure for pushing the needle toward an injection hole side is supplied from the fuel supply source; and a pressure booster unit for increasing the pressure of the fuel stored in the fuel storage by actuation of a booster piston; wherein the needle is forced to open the injection hole by reducing the pressure of fuel in the injection control chamber to thereby inject the fuel stored in the fuel storage from the injection hole, while the needle is forced to close the injection hole by increasing the pressure of the fuel in the injection control chamber to thereby terminate injection of fuel from the injection hole;

inflow and outflow of fuel are performed in the injection control chamber in such a manner that a flow amount of fuel flowing out from the injection control chamber during a valve-opening stroke of the needle to open the injection hole is smaller than a flow amount of fuel flowing into the injection control chamber during a valve-closing stroke of the needle to close the injection hole, and the pressure of fuel in the fuel storage at a time when the booster piston is actuated is regulated by adjusting the fuel pressure in the fuel supply source, to thereby enable adjustment of a fuel injection rate during the valve-opening stroke.

2. The fuel injection device according to claim 1, wherein the pressure booster unit comprises a booster chamber communicating with the fuel storage and pressurized by actuation of the booster piston, and a booster control chamber in which the pressure of supplying fuel is regulated to control the actuation of the booster piston;

fuel supply from the booster chamber to the injection control chamber is blocked;

both the fuel pressure in the injection control chamber and the fuel pressure in the booster control chamber are controlled by means of a common control valve;

the booster chamber is connected via a check valve to the injection control chamber; and the check valve allows a flow of fuel from the injection control chamber to the booster chamber while blocking a flow of fuel from the booster chamber to the injection control chamber.

3. The fuel injection device according to claim 1, wherein the pressure booster unit comprises a booster chamber communicating with the fuel storage and pressurized by actuation of the booster piston, and a booster control chamber in which the pressure of supplying fuel is regulated to control the actuation of the booster piston;

fuel supply from the booster chamber to the injection control chamber is blocked;

both the fuel pressure in the injection control chamber and the fuel pressure in the booster control chamber are controlled by means of a common control valve;

the booster control chamber is connected via a check valve to the booster chamber; and the check valve allows a flow of fuel from the booster control chamber to the booster chamber while blocking a flow of fuel from the booster chamber to the booster control chamber.

4. The fuel injection device according to claim 1, further comprising:

a controller that controls the pressure of fuel in the fuel storage at a time when the booster piston is actuated by controlling the fuel pressure in the fuel supply source, to thereby control the fuel injection rate during the valve-opening stroke.

5. The fuel injection device according to claim 1, further comprising:

a control valve for selectively connecting the injection control chamber to the fuel supply source or a drain; and a one-way orifice disposed between the control valve and the injection control chamber, in which an area of a channel through which fuel flows from the injection control chamber to the control valve is smaller than that of a channel through which fuel flows from the control valve to the injection control chamber.

* * * * *